US008523134B2

(12) United States Patent
Walker et al.

(10) Patent No.: US 8,523,134 B2
(45) Date of Patent: Sep. 3, 2013

(54) GROUND SPIKE

(75) Inventors: Simon Walker, Tsawwassen (CA); Mark Hopkinson, Delta (CA); Jianzhong Zhu, Suzhou (CN)

(73) Assignee: Peak Innovations Inc., Richmond, BC ( * ) Notice: Subject to any disclaimer, the term of this patent is extended or adjusted under 35 U.S.C. 154(b) by 0 days.

(21) Appl. No.: 12/445,281

(22) PCT Filed: Oct. 11, 2007

(86) PCT No.: PCT/CA2007/001813

§ 371 (c)(1),
(2), (4) Date: Apr. 13, 2010

(87) PCT Pub. No.: WO2008/043178

PCT Pub. Date: Apr. 17, 2008

(65) Prior Publication Data

US 2010/0186314 A1 Jul. 29, 2010

(30) Foreign Application Priority Data

Oct. 11, 2006 (CA) ..... 2563135
Jan. 16, 2007 (CA) ..... 2573995

(51) Int. Cl.
*E02D 5/80* (2006.01)
*E04H 12/22* (2006.01)

(52) U.S. Cl.
USPC ..... 248/508; 248/530; 248/156

(58) Field of Classification Search
USPC ..... 248/508, 507, 530, 156, 545, 532–533, 248/85–88; D8/1, 373; 52/165, 4, 154, 155, 52/102; 47/47; 135/118; D11/130.1; D21/840; 256/1; 40/607.05–607.06
See application file for complete search history.

(56) References Cited

U.S. PATENT DOCUMENTS

| | | | | | |
|---|---|---|---|---|---|
| 1,970,697 | A | * | 8/1934 | Hammitt | 40/668 |
| 2,322,600 | A | * | 6/1943 | Stahler | 248/545 |
| 3,280,829 | A | * | 10/1966 | Glendenning et al. | 135/118 |
| 3,807,089 | A | * | 4/1974 | Senese | 47/46 |
| D243,614 | S | * | 3/1977 | Russo | D25/126 |
| 4,185,424 | A | * | 1/1980 | Streit | 52/103 |
| 4,249,715 | A | | 2/1981 | Repp | |
| 4,271,646 | A | * | 6/1981 | Mills | 52/165 |
| 4,588,157 | A | | 5/1986 | Mills | |
| 4,651,399 | A | | 3/1987 | Moraly | |
| 4,852,834 | A | * | 8/1989 | Hosman | 248/156 |

(Continued)

FOREIGN PATENT DOCUMENTS

| | | |
|---|---|---|
| EP | 0144870 A2 | 6/1985 |
| EP | 0657604 B1 | 10/1994 |

(Continued)

*Primary Examiner* — Terrell McKinnon
*Assistant Examiner* — Ingrid M Weinhold
(74) *Attorney, Agent, or Firm* — Smiths IP

(57) ABSTRACT

A ground spike is disclosed having a plurality of blades and a flat plate secured thereto. The blades each have a reinforcement deformation proximal to a longitudinal outer edge. The reinforcement deformation may be a reinforcement line stamped therein, may be a bent outer edge, or the like. Objects may be attached to the flat plate, thereby securing such objects to the ground when the ground spike is used. The ground spike may have a post receiving socket secured to the flat plate. Each component may comprise metals of varying thickness and rigidity or other suitable materials.

42 Claims, 21 Drawing Sheets

(56) References Cited

U.S. PATENT DOCUMENTS

| | | | | | |
|---|---|---|---|---|---|
| 4,874,149 | A | | 10/1989 | Miceli | |
| D316,367 | S | | 4/1991 | Olson | |
| 5,090,656 | A | * | 2/1992 | Brown | 248/545 |
| D325,870 | S | | 5/1992 | Niles | |
| 5,230,187 | A | | 7/1993 | Reimann | |
| 5,287,671 | A | | 2/1994 | Ueki | |
| D349,434 | S | | 8/1994 | Archambeau | |
| 5,456,441 | A | | 10/1995 | Callies | |
| 5,788,361 | A | * | 8/1998 | Lee | 362/249.16 |
| 5,860,636 | A | * | 1/1999 | Duncan et al. | 256/1 |
| D406,249 | S | * | 3/1999 | Bolster | D11/130.1 |
| 6,039,298 | A | | 3/2000 | Stier | |
| 6,273,390 | B1 | | 8/2001 | Meyer | |
| 6,401,408 | B1 | * | 6/2002 | Schwartz et al. | 52/155 |
| D493,205 | S | * | 7/2004 | Combes | D21/840 |
| 6,886,296 | B1 | * | 5/2005 | John et al. | 52/170 |
| 7,219,872 | B2 | | 5/2007 | Walker | |
| 2005/0279897 | A1 | * | 12/2005 | Callies | 248/218.4 |

FOREIGN PATENT DOCUMENTS

| | | | |
|---|---|---|---|
| GB | 1461802 | | 1/1977 |
| GB | 2140839 | A | 12/1984 |
| GB | 2151273 | A | 7/1985 |
| GB | 2152550 | A | 8/1985 |
| GB | 2153403 | A | 8/1985 |
| GB | 2195373 | A | 4/1988 |
| GB | 2207451 | A | 2/1989 |
| GB | 2225038 | A | 5/1990 |
| GB | 2268523 | A | 7/1992 |
| GB | 2284435 | A | 12/1993 |
| GB | 2277754 | A | 11/1994 |
| GB | 2283994 | A | 5/1995 |
| GB | 2295628 | A | 6/1996 |
| GB | 2322877 | A | 3/1997 |
| GB | 2355996 | A | 11/1999 |
| GB | 2360301 | B | 6/2003 |
| NZ | 242387 | | 5/1994 |
| NZ | 519409 | | 8/2003 |
| WO | 95/29313 | A1 | 11/1995 |

* cited by examiner

Fig. 8
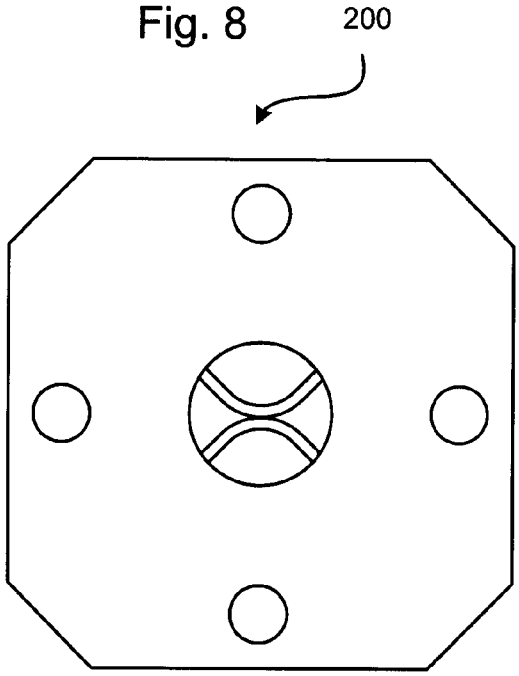
Fig. 10
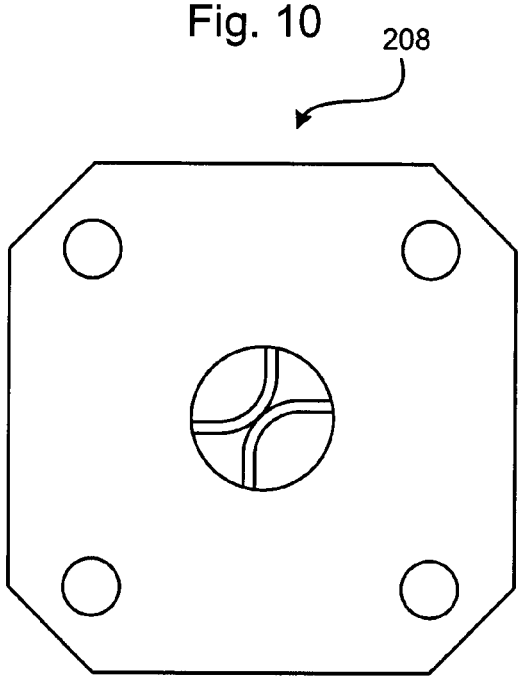
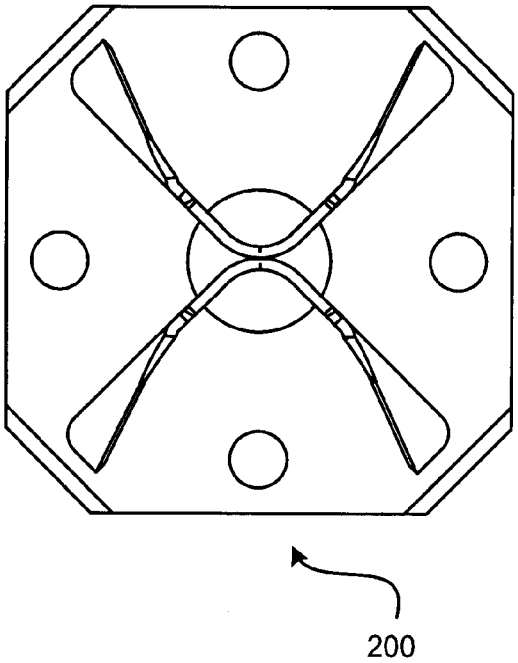
Fig. 9
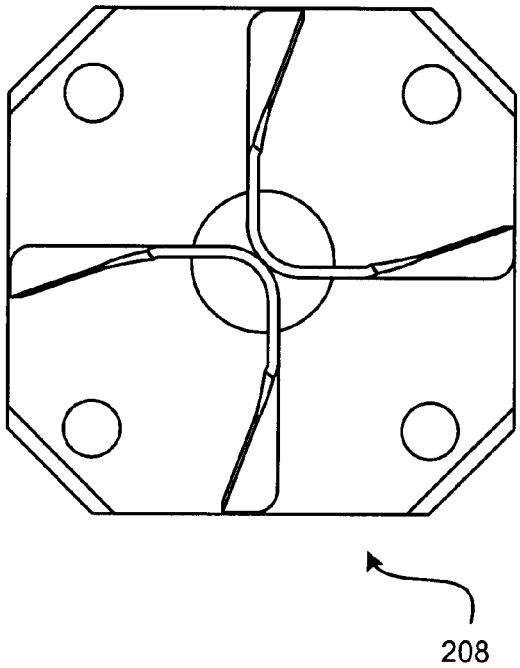
Fig. 11

GROUND SPIKE

FIELD OF THE INVENTION

This invention relates to supporting and firmly anchoring vertical posts, such as fence posts and the like, in the ground.

REFERENCE TO EARLIER FILED APPLICATION

This application claims priority from Canadian patent application No. 2,563,135 filed Oct. 11, 2006 and Canadian patent application No. 2,573,995 filed Jan. 16, 2007.

BACKGROUND OF THE INVENTION

It is desirable to be able to securely fasten various objects to the ground. One object that is commonly secured to the ground is a vertical post.

When installing a vertical post, such as a fence post, it is common to support the post in the ground by one of: (1) burying one end of the post in a hole dug in the ground; (2) filling the area around the base of the post with concrete; or (3) securing the post to a ground spike that, in turn, is secured into the ground.

Burying one end of the post in the ground is often unsatisfactory for various reasons, including that digging out a suitable hole and burying the post may be difficult and the ground may not provide suitable support. This may result in a wobbly post that is not well suited for anchoring a fence or the like. A buried post may also be susceptible to rot.

Filling the area around the base of the post with concrete has its own limitations. This requires digging suitable holes around each post, acquiring sufficient concrete to set each post, mixing concrete, pouring concrete into holes around each post, and ensuring that the post is held straight while the concrete sets.

Securing posts to post support means, such as metal ground spikes, is a relatively easy and cost efficient alternative for securing a post to the ground.

Metal ground spike post supports of varying shapes have been used to secure posts to the ground. U.S. Pat. No. 4,271,646 to Mills discloses a prior art metal post support (2) having a ground engaging blade portion (4) and a post supporting hollow box portion (6) as shown in FIGS. 1 and 2. Mills discloses four blades (8) disposed in a cross-shaped cross-section, meeting at a central joint (10). Each of the four blades (8) is welded to a flat plate (16), which in turn is welded onto the sides (12) of the hollow box portion (6). The Mills post support is made of mild steel plate of one-eighth inch thickness (3.2 mm). To allow drainage of water entering the box-section (14), drain holes may be drilled in the plate (16). To secure a post to the Mills post support, holes may drilled in the sides (12), through which bolts can be inserted.

A second common ground spike post support (20) is illustrated in FIG. 3. The common ground spike (20) has a blade portion (21) comprising four blades (22), and a post socket portion (30). The blade portion may be made by cutting two pieces of metal, then bending the two halves of each piece of the metal into a perpendicular arrangement along a longitudinal fold line (23 or 24). The two pieces of metal are then attached along the respective fold lines by a welded connection (25).

The post socket portion (30) is made from a unitary piece of metal. Three perpendicular bends (along bend lines 32) form four walls (31) to the post socket (30). Perpendicular bends (along bend lines 34) enable base tabs (35) to form a partially closed lower surface of the post socket (30). Clamping tabs (36) are formed in one corner of the post socket (30) by additional bends (along lines 33) in the metal. Apertures (38) for bolt connectors appear in the clamping tabs (36).

The blade portion (21) is attached to the post socket portion (30) by a welded connection (28) between the top of each blade (22) and the lower face of the base tabs (35).

The blade portion (21) and post socket portion (30) of the common ground spike (20) are typically made of the same metal material, often having a thickness of between 2.5 mm and 3.5 mm. Mills discloses use of steel having a thickness of one-eighth inch (3.2 mm). The cost of the metal starting material is a major component of the cost of producing a ground spike. Reducing the thickness of metal for the prior art ground spike designs result in premature deformations and failures under normal to heavy wear conditions.

There exists a need for stronger, improved blades for a ground spike post support. There exists a need for a stronger, improved ground spike design, preferably that requires less metal such that it can be manufactured for a lower cost without sacrificing product quality.

BRIEF DESCRIPTION OF THE DRAWINGS

The invention will be described with reference to the detailed description of the invention and to the drawings thereof in which:

FIG. 8 is a top plan view of an embodiment of the invention;

FIG. 9 is a bottom plan view of an embodiment of the invention;

FIG. 10 is a top plan view of an embodiment of the invention;

FIG. 11 is a bottom plan view of an embodiment of the invention;

DETAILED DESCRIPTION OF THE INVENTION

Throughout the following description specific details are set out to provide a more thorough understanding of the invention. However, the invention may be practiced without these particulars. In other instances, well known elements have not been shown or described in detail to avoid unnecessarily obscuring the present invention. Accordingly, the description and drawings are to be regarded in an illustrative, rather than a restrictive, sense.

Figure 1:
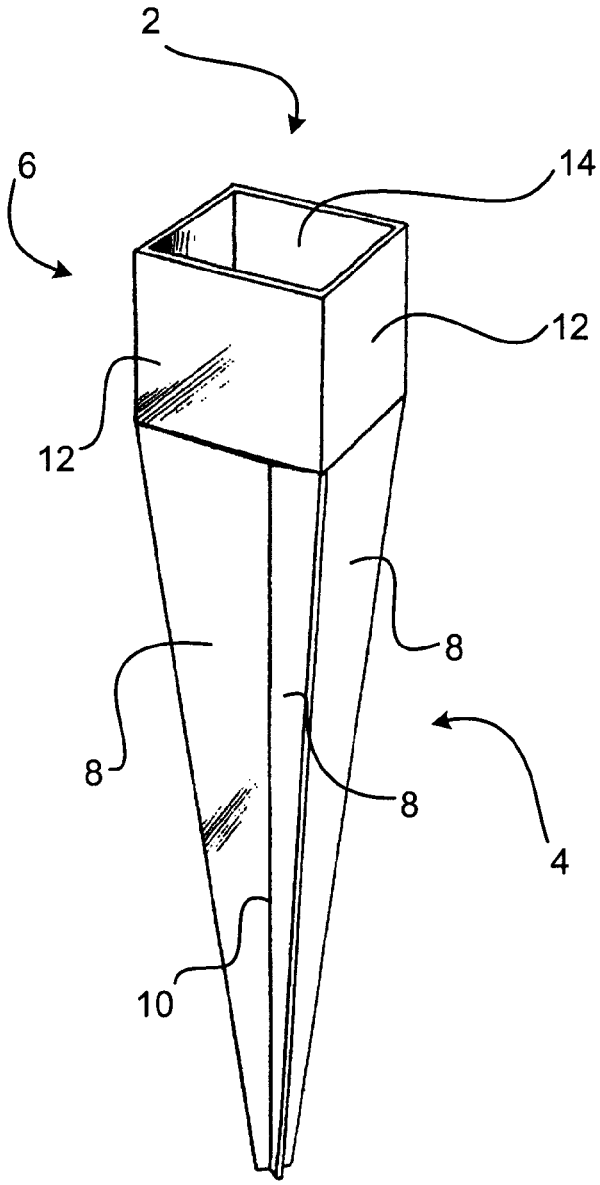
Fig. 1 (Prior Art)
FIG. 1 is a perspective view of a first prior art ground spike post support.
Figure 2:
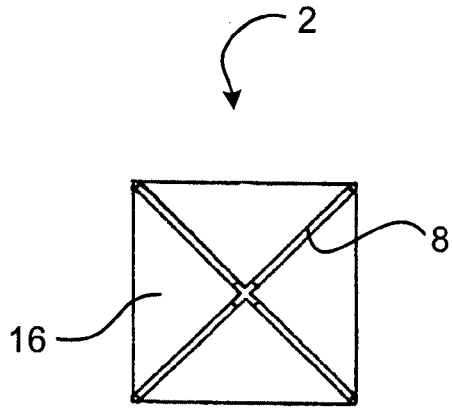
Fig. 2 (Prior Art)
FIG. 2 is a bottom plan view of the first prior art ground spike post support.
Figure 3:
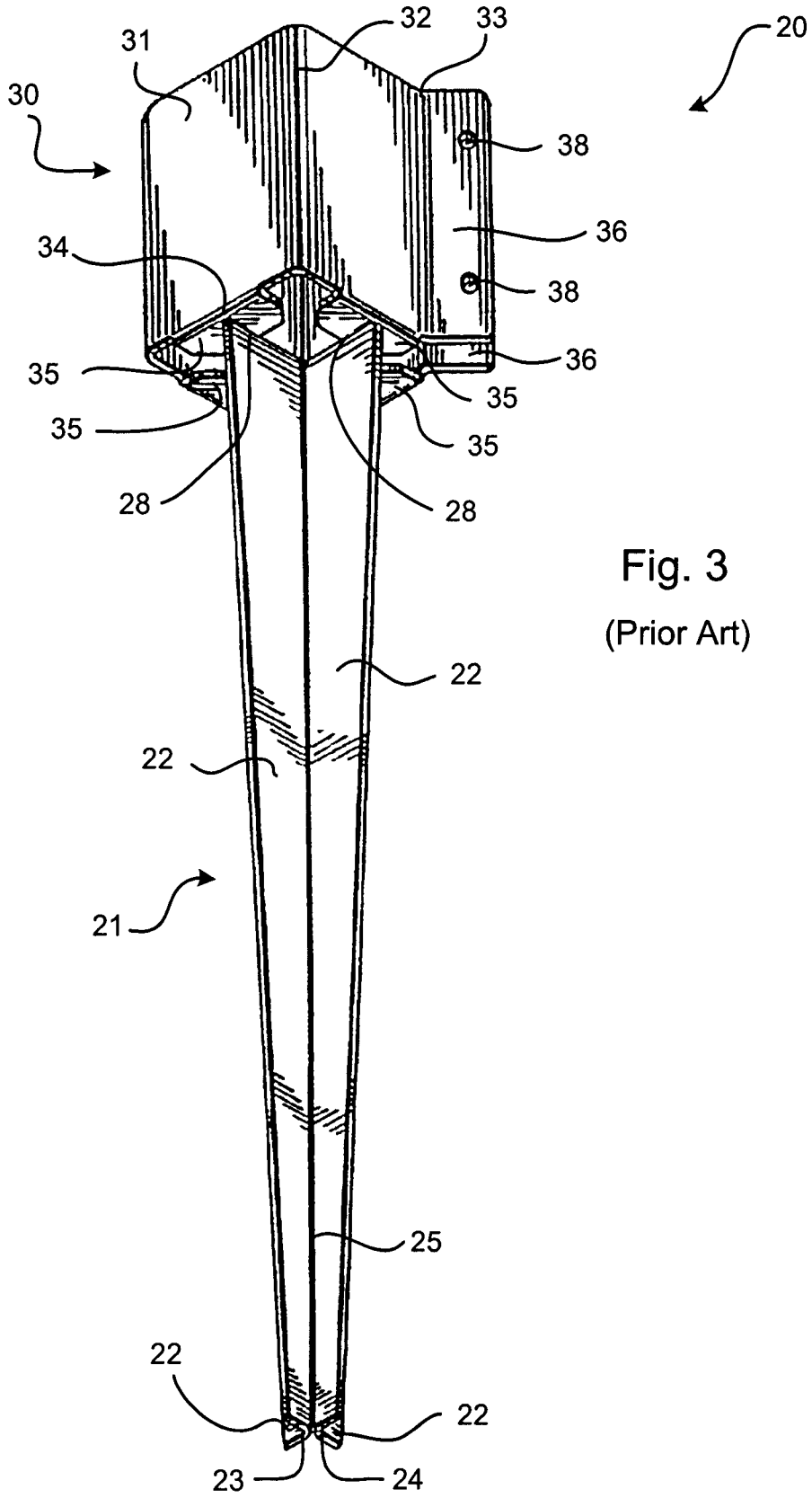
Fig. 3 (Prior Art)
FIG. 3 is a perspective view of a second prior art ground spike post support.
Figure 4:
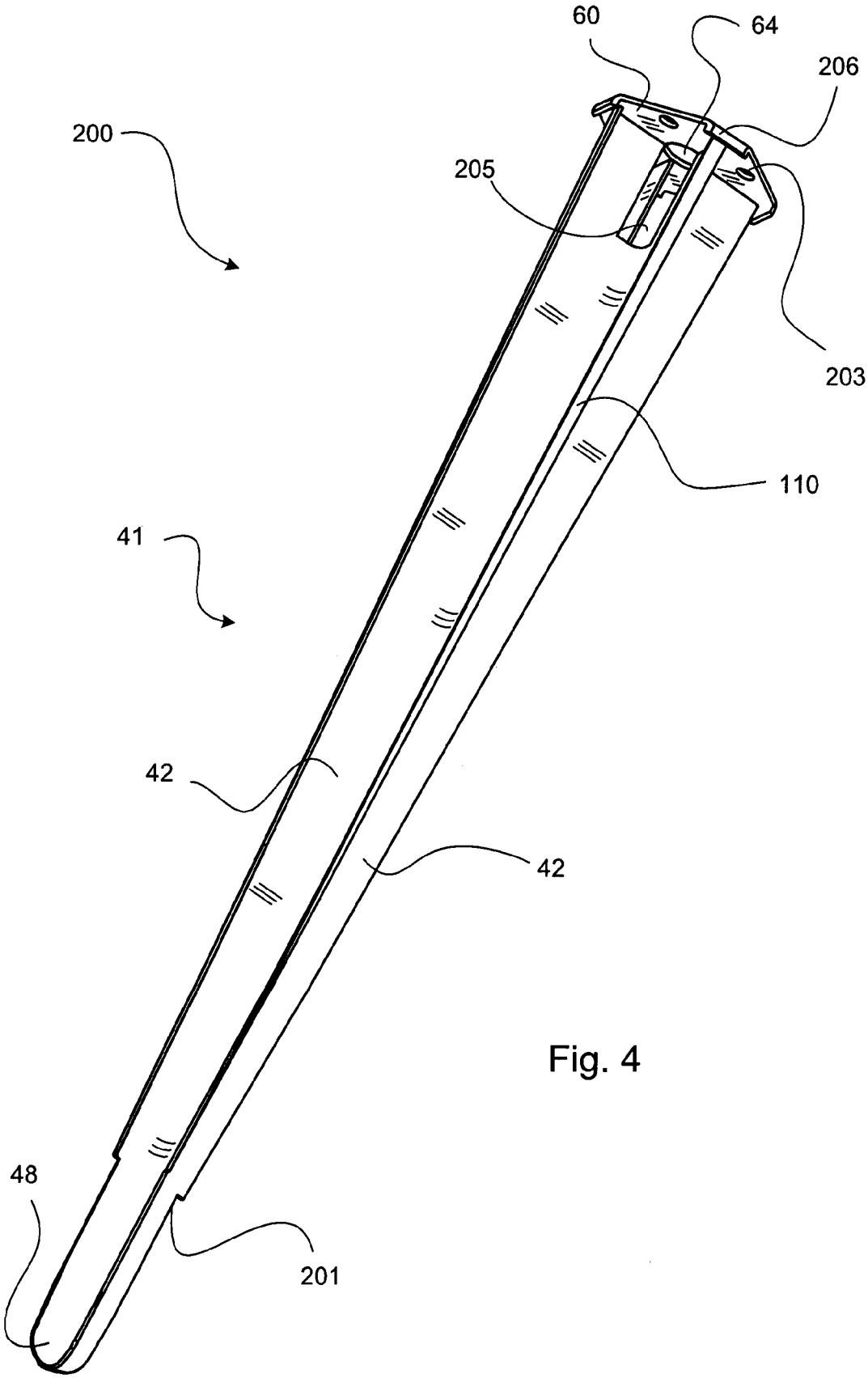
FIG. 4 is a perspective view of an embodiment of the invention.
Figure 5:
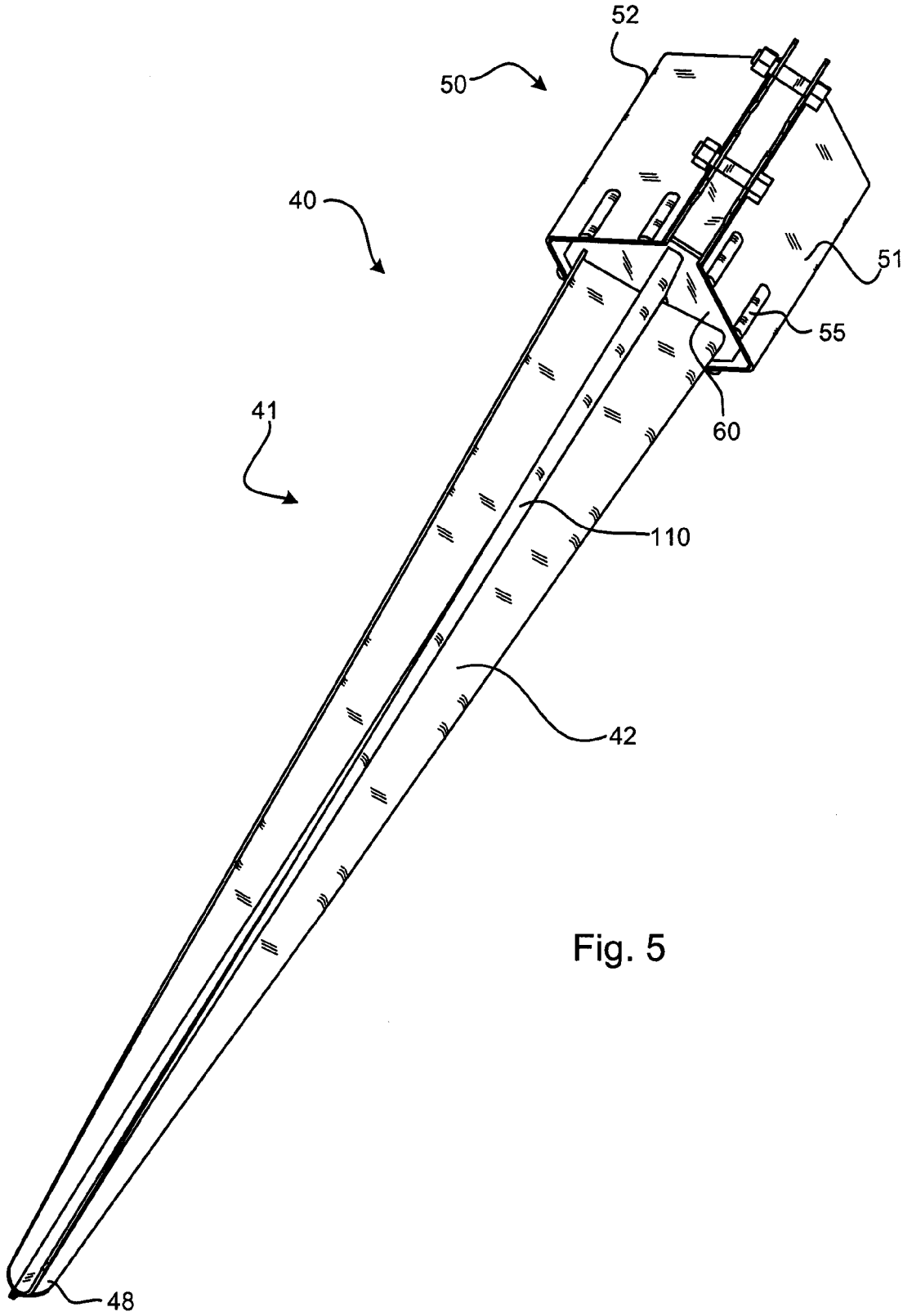
FIG. 5 is a perspective view of an embodiment of the invention.

With reference to FIG. 4 and subsequent figures, embodiment 200 comprises a ground engaging blade portion 41 and a base plate 60.

The blade portion 41 comprises a plurality of blades 42 designed for driving into the ground. In embodiment 40, there are four blades 42, though alternate embodiments may have two, three, five, six or more blades. The blades have a reinforcement deformation proximal to a longitudinal outer edge thereof. In embodiment 200 the reinforcement deformation comprises a bent outer edge 110. In certain other embodiments, such as embodiments 40', 104 and 106, reinforcement deformations are illustrated as reinforcement lines that have been stamped or otherwise marked as lines 46, 47 into the blades. Each reinforcement line has a convex portion 46 on one side of the blade and a corresponding concave portion 47 on the other side of the blade.

Where the reinforcement deformation comprises a bent outer edge 110, the blade may be bent proximal to a longitudinal outer edge thereof. At the top end of the blade, the distance 111 from the edge of the blade and the bend line may be any suitable distance. To minimize material the need for extra material, a distance between 2.5 mm and 10 mm may be suitable, and a distance of approximately 5 mm may be preferable. In many embodiments the blades taper from the top end of the blade down to the tip 48. This may make folding the blade difficult near the tip. The fold line may taper closer to the edge of the blade closer to the blade tip 48. The bent outer edge 110 may be not run the entire length of the blade, but rather stop at point 201 short of the tip of the blade by as much as 5% to 35% as shown in FIG. 4. In embodiment 200, the bent outer edge 110 terminates about 10% to 20% of the length L of the blade away from the tip 43 of the blade, and particularly about 15% away from the tip 43.

The bend for the edge portion 110 may be any suitable angle 164, such as 45 degrees to 120 degrees, or preferably between 80 degrees and 100 degrees, and most preferably approximately 90 degrees. Other angles less than 45 degrees or greater than 120 degrees may also be suitable for enhancing the strength of the blade to resist torsion forces when in use.

Figure 6:
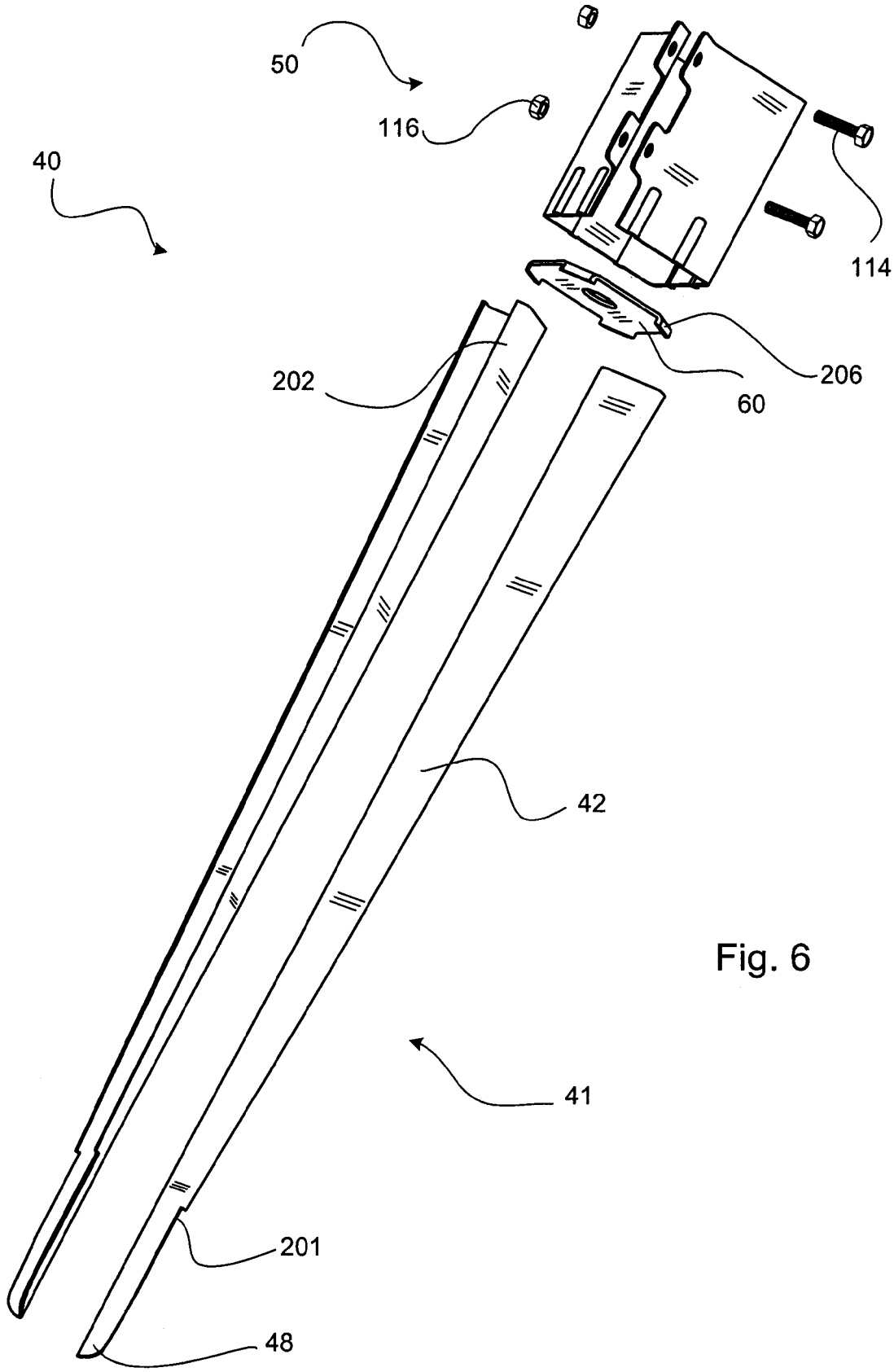
FIG. 6 is an exploded perspective view of an embodiment of the invention.
Figure 7:
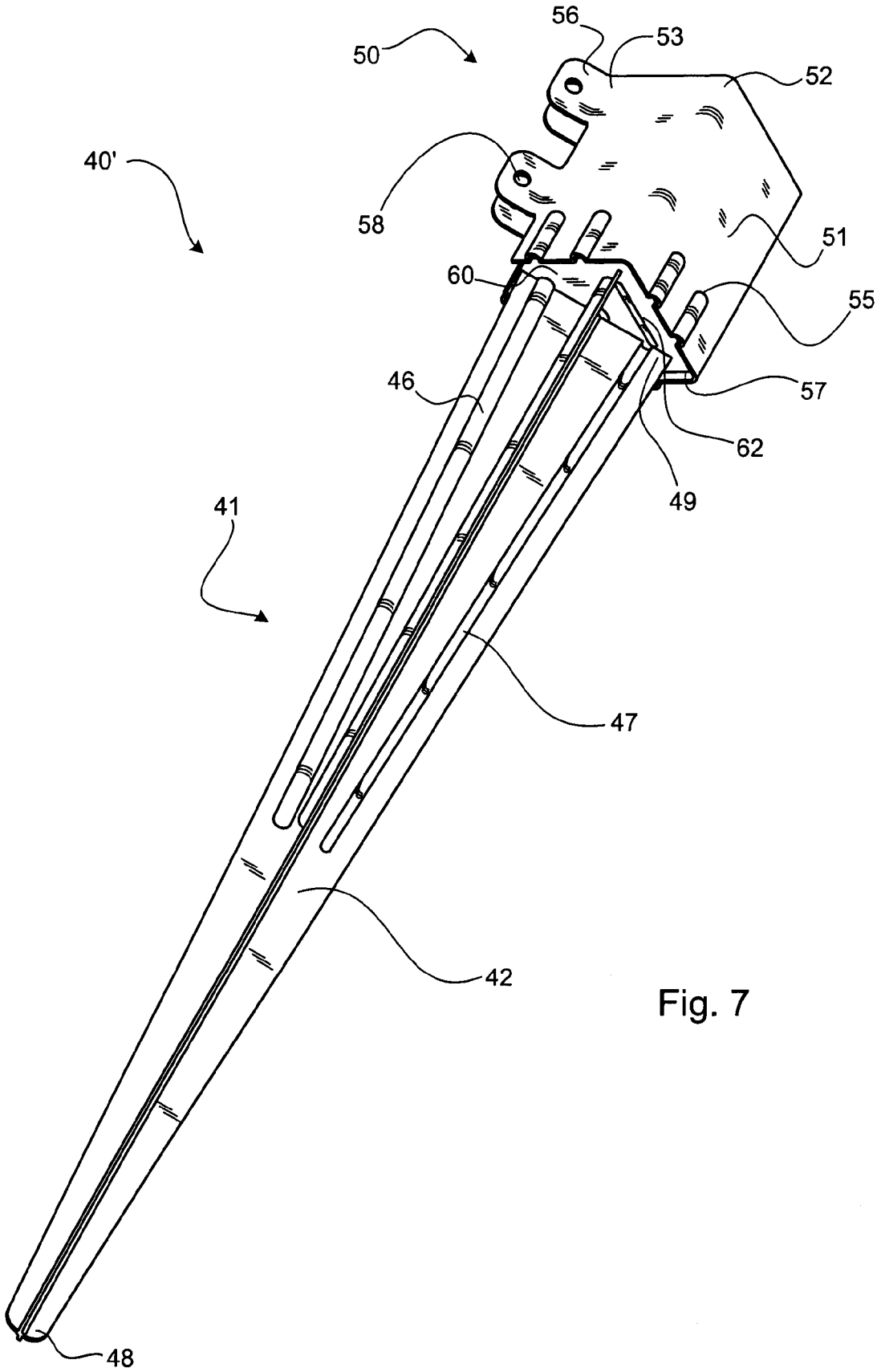
FIG. 7 is a perspective view of an embodiment of the invention.
Figure 14:
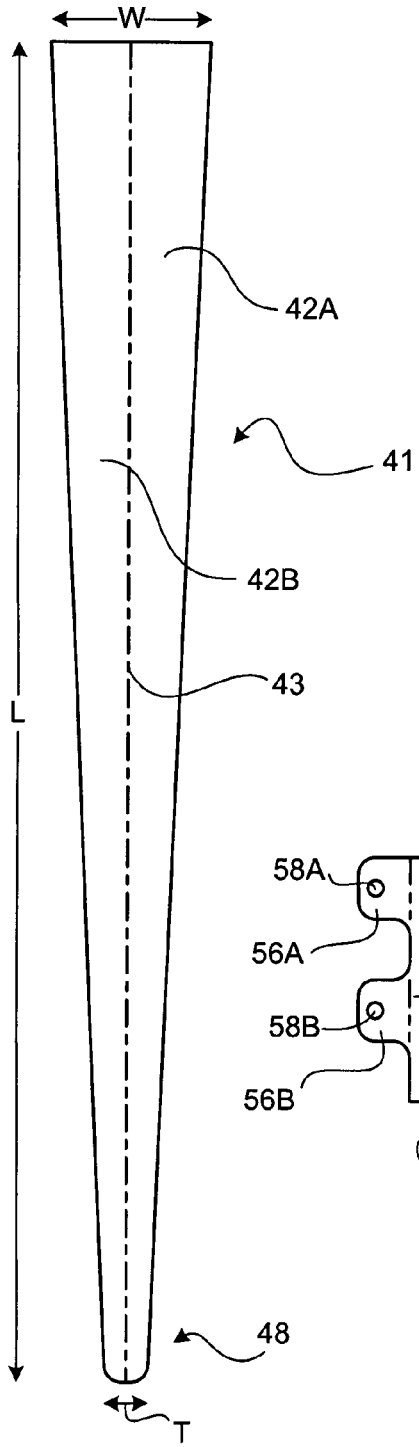
FIG. 14 is a plan view of starting material used in the construction of a blade portion of an embodiment of the invention.
Figure 17:
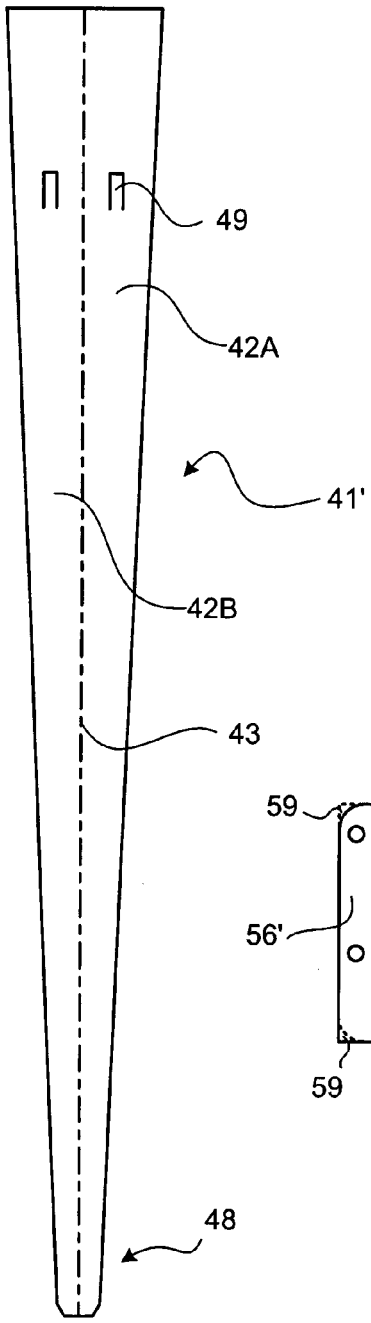
FIG. 17 is a plan view of starting material used in the construction of a blade portion of an embodiment of the invention.

The blade portion 41 may be made from two pieces of metal, each having been cut, for example as shown in FIG. 14, 17 or 6. Bending of the edges of the blades or stamping of reinforcement lines 46, 47 on the blades 42 may occur before, after or contemporaneously with the cutting of the blade material. The material is then bent at a substantially perpendicular angle along fold line 43 to form two blades 42A and 42B. This is repeated for a second piece of blade material which is folded to form two blades 42C and 42D along fold line 44. The two pieces of blade material may then be welded together along join 45. Welding may be applied in 2, 3, 4 or more discrete portions of the join 45, or it may be applied along the entire join.

The welds may comprise spot welds. In certain embodiments, regular welds are applied at the top and bottom of the join 45 and spot welds are applied in 1, 2, 3, 4, 5, or more positions along join 45.

Figure 12:
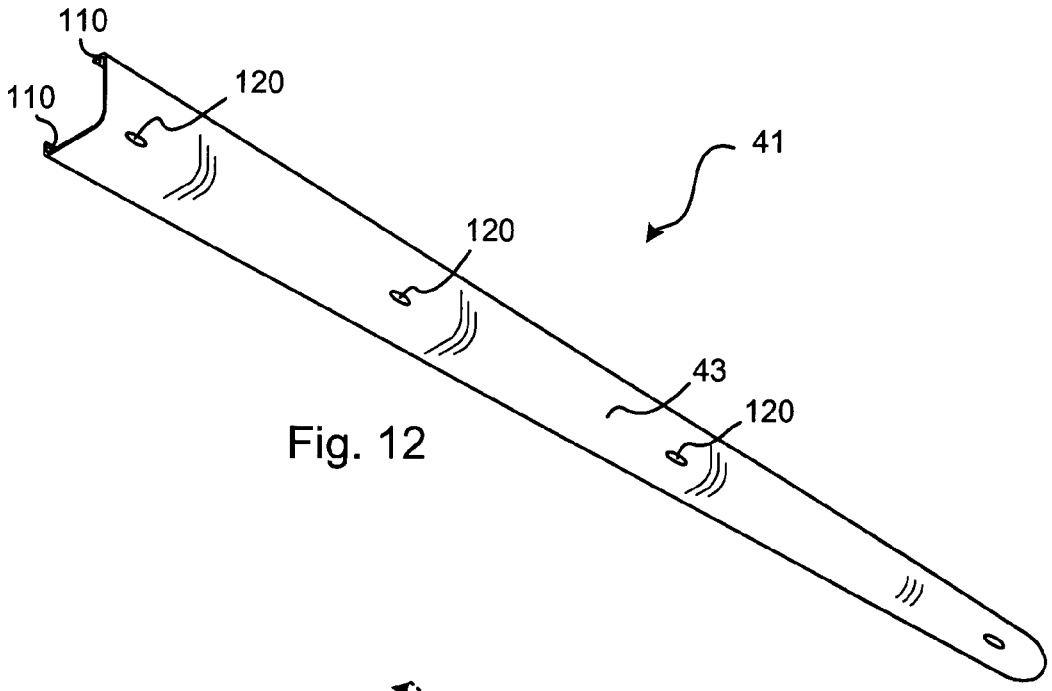
FIG. 12 is a perspective view of a portion of blade material according to an embodiment of the invention.

As shown in FIG. 12, multiple holes 120 may be cut in the blade material along fold line 43 to facilitate the welding process. In this case regular welds can be applied in each hole. FIG. 12 illustrates 4 holes, although 2, 3, 5 or more holes may also be provided in accordance with this invention.

To facilitate the welding process, discrete apertures may be cut along fold lines 43 and 44. The discrete apertures can coincide with the portions to be welded so that the weld may be applied from a single side of the blades.

If the outer edges of the blades are bent due to the stamping of reinforcement lines, the edge of the blades may be straightened, such as by mechanical straightening. This can occur before or after the bending of the blade material.

In alternate embodiments, the blade portion may be constructed without folding by welding individual blade pieces together along join 45.

Base plate 60 is preferably formed of a unitary piece of metal. The base plate 60 may comprise apertures 203 for securing means to the ground spike. Any item that is desired to be secured to the ground could be secured to the base plate. For example, a metal fence could be bolted to the base plate, possibly via a foot joint for securing the post to the plate 60. Other items could also be secured to the base plate 60 such as floodlights, sprinkler systems, lawn ornaments, etc. The size of the base plate 60 can vary significantly depending upon the desired use. Apertures 203 may also be of different shape, such as oblong if the ability to laterally position an object away from the centre of the ground spike is desired. The rotational positioning of the blades with respect to the base plate may also be varied as shown with reference to FIGS. 8-11 and embodiments 200 and 208.

The base plate may be reinforced with reinforcement deformations. The reinforcement deformation may comprise a bent outer edge 206 or may comprise reinforcement lines 62.

Figure 15:
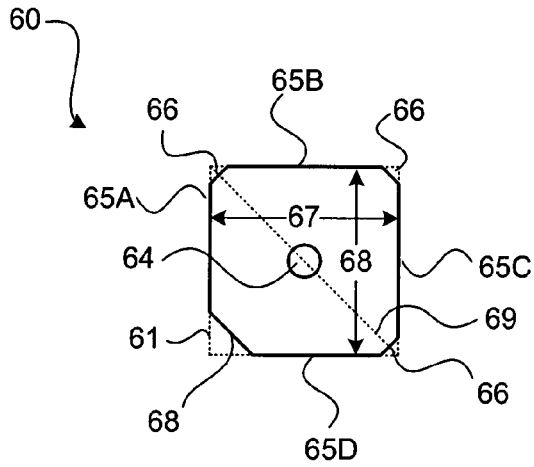
FIG. 15 is a plan view of starting material used in the construction of a base plate of an embodiment of the invention.
Figure 16:
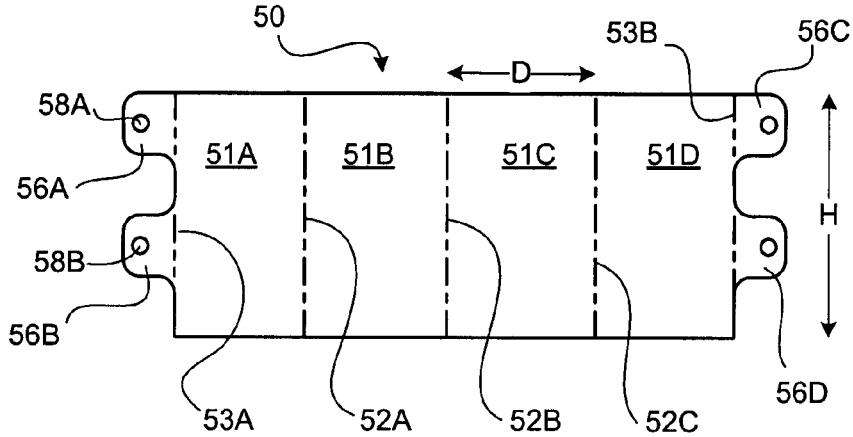
FIG. 16 is a plan view of starting material used in the construction of a socket portion of an embodiment of the invention.
Figure 19:
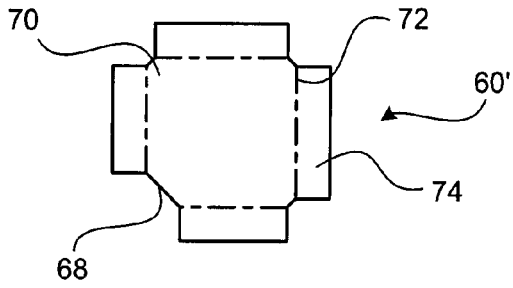
FIG. 19 is a plan view of starting material used in the construction of a base plate of an embodiment of the invention.
Figure 18:
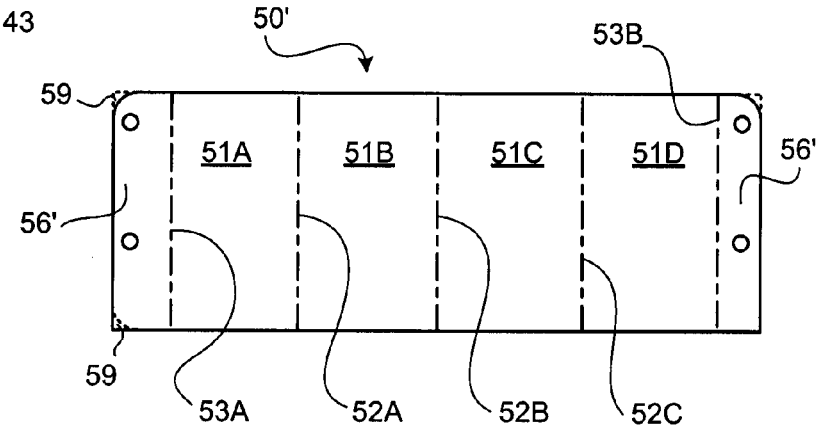
FIG. 18 is a plan view of starting material used in the construction of a socket portion of an embodiment of the invention.

In certain embodiments, such as embodiment 40, the base plate is secured to each of the sides of the socket portion 50. As shown in FIGS. 15 and 19, socket base plate 60 has four main sides 65 that define a square in the approximate dimensions of the inside of the socket portion 50. Each of the four corners of the square may be cut out. Socket base plate 60 has three removed corners 66 of equal size, and a larger removed corner 68 to correspond with the corner in which the clamping tabs 56 are located in embodiment 40. Socket base plate 60 may have a central aperture 64. The central aperture 64 and the cut-out corners 66 may assist in the drainage of water or liquids when in use, and may assist in powder coating or painting during manufacture. Bent edges 206 may assist with reinforcement of the plate 60, particularly against torsion forces when the ground spike is in use.

Reinforcement lines 62 may be stamped into socket base plate 60 for increased strength and rigidity, which may increase the resistance of the base plate 60 to torsion forces.

Figure 13:
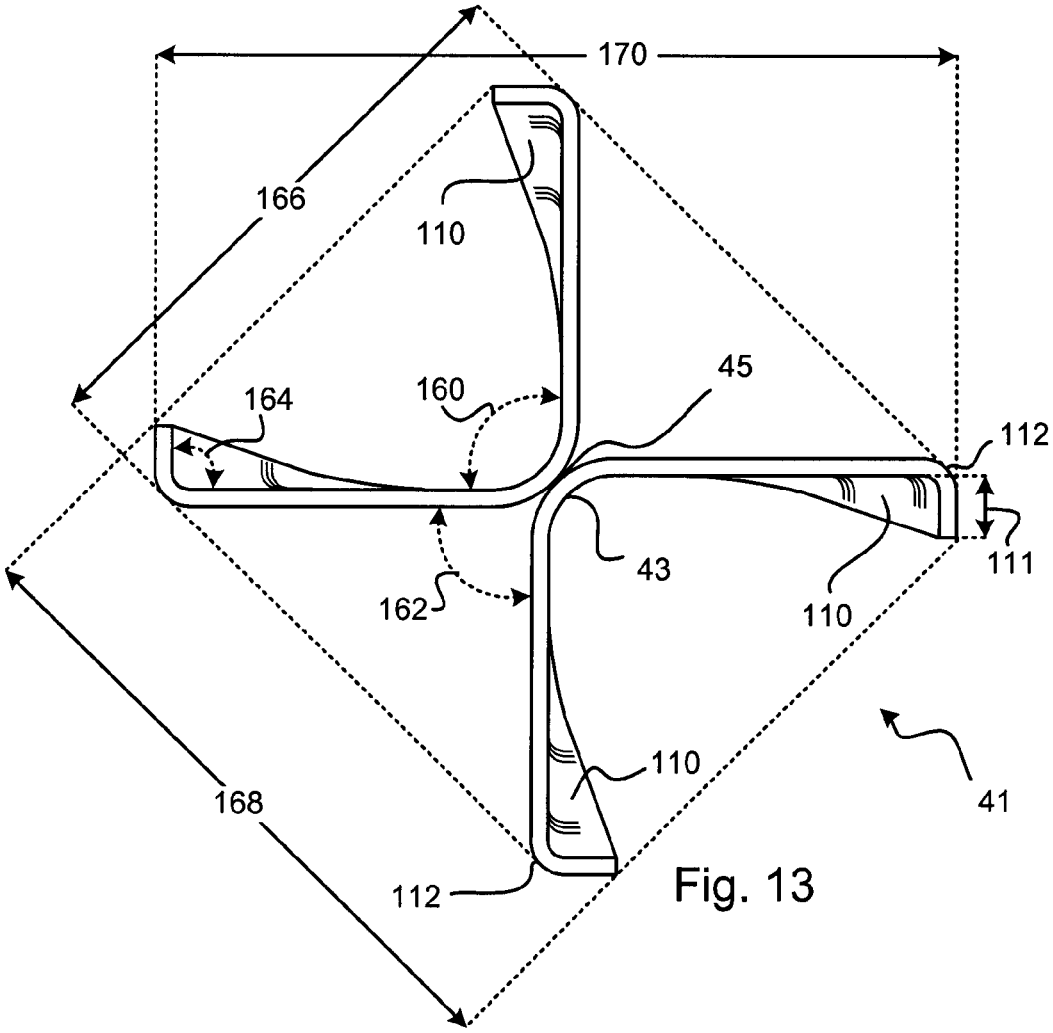
FIG. 13 is a cross-sectional top plan view of a blade portion according to an embodiment of the invention.

With reference to FIG. 13, where the blade portion 41 has four blades, made from two pieces of metal, the angles 160 and 162 may be varied away from 90 degrees. Where two blades are made out of a unitary piece of metal such as shown in FIGS. 12 and 13, and where the two edges 110 are bent towards each other, arranging four blades at 90 degrees to each other would result in uneven soil displacement/working areas. For example, where angles 160 and 162 are 90 degrees, the distance 166 that could exert pressure on surrounding ground would be less than the distance 168, and will be much less than the distance 170. Distance 166 forms the shortest footprint distance of the ground spike. Depending upon which direction external forces pressure the ground spike when it is bearing a load in the ground, it may be desirable to maximize the shortest footprint distance, such as by making distance 166 approximately equivalent to distance 168. This can be done by varying the angles 160 and 162 as necessary. For example, an angle of about 95 degrees for 160 and a resulting angle of about 85 degrees for 162 may result in distance 166 approximately equaling distance 168.

Embodiment 40 further comprises a post receiving socket portion 50. The post supporting socket portion 50 comprises four side walls 51 that are in a substantially perpendicular arrangement to each other. Reinforcement lines 55 may be stamped or otherwise marked in each side wall 51. The reinforcement lines 55 may be concentrated on the lower portion of the socket portion 50, or may extend further up the side walls 51. One, two, three, or more reinforcement lines 55 may be applied to each side wall 51.

Clamping tabs 56 may be provided on one or more corners of the socket portion 50. The clamping tabs may take one of various forms known in the art. Examples of differently shaped clamping mechanisms can be seen with reference to embodiments 80, 82, and 84. Clamping tabs have apertures 58 to allow a bolt to pass therethrough for tightening the socket portion 50 on a post placed therein during installation. Clamping tabs may have one, two, three, or more apertures 58 to allow various numbers of bolts to secure the socket portion 50 to a post.

Once the blade portion 41, the socket portion 50, and the socket base plate 60 have been manufactured as described above, embodiment 40 is further assembled by welding each of the four sides 65 of the socket base plate to a side wall 51 of the socket portion 50. For example, side 65A may be welded to side wall 51A, and side 65B may be welded to side wall 51B, etc. The length of the weld between each side 65 and side wall 51 is almost the entire depth D of each side wall 51.

The length L of the blades may be any suitable length, for example between 40 and 10 inches, or more preferably between 32 and 24 inches. The length of the blades portion 41 may be varied according to the soil conditions of the application.

The width W of the blades may be any suitable length for a given application. Where the application is for supporting a 4×4 post, which is generally 3.5" by 3.5" wide, the inside depth D of each side wall 51 of the socket portion 50 may be slightly more than 3.5". In this case the width W will be the same or less than the distance between opposing sides 65 of the square 61 defined by plate 60 if the blades 42 are welded to the plate 60 at angles parallel to the sides 65. In embodiments where the blades 42 are parallel to the sides 65, width W will be between 3.5" and 2.5", and more preferably between 3.5" and 3", and most preferably between 3.5" and 3.3". In embodiments where the blades 42 are welded to the plate 60 at approximately 45 degree angles to the sides 65 (i.e. the top surface of the blades extend towards the corners of square 61), then width W must be the same or less than the length of a diagonal line that would extend from corner to opposite corner of the square 61. For supporting a 4×4 post that is 3.5" by 3.5" wide, the diagonal line 69 extending between opposite corners of square 61 may be about 5". For embodiments with blades welded to plate 60 generally along diagonal line 69, the width W will be between 5" and 2.5", preferably between 5" and 4" and more preferably between 4.9" and 4.5".

The blades taper from the top to the bottom, such that the width T at the tip of the blades is significantly less than the width W at the top of the blade portion.

It is noted that the width W, which is illustrated as being the width of the piece of material that is bent to form blades 42A and 42B, is approximately the same as the width of the top portion of the assembled blade portion 41. Similarly the width T is generally the same as the width of the tip portion 48 of the assembled blade portion 41. Although in practice these widths may vary, particularly due to variations in the curvature of bends 43 and 44 and in the welds joint 45, for ease of reference in this section widths W and T are treated as equivalent and therefore reference to one of these widths may be applied to either width value.

Height H of the socket portion 50 may be any suitable height. If height H is too high, the post support will not be suitable for constructing certain fences because dogs, raccoons or other animals may fit under the fence. For 4×4 post installations, height H may be between 6.5" to 4" or more preferably between 4.75" and 5.75", and most preferably between 5" and 5.5".

Alternate embodiments of the blade portion 41', the socket portion 50' and the plate 60' are within the scope of the invention. Blade portion 41' has cut outs 49 which protrude from one side of the blade. Other alterations to the surface of the blades, including stamped out portions or alternative reinforcement mechanisms are understood to fall within the scope of the invention. The blade tip 48 may be of any suitable shape, including having a rounded end, having tips cut off, or with the tips square (not shown).

Plate 60' has tabs 74 that may be folded perpendicular to the flat surface 70 along lines 72. Plate 60' may be welded to the side walls 51 of the socket portion 50 along one or both of the fold line 72 and the outer edge of tab 74.

Socket portion 50' shows alternate embodiments for clamping tabs 56' in which the entire tab, that may have two apertures 58, remains as a single piece of material. The corners 59 of the clamping tabs 56' may or may not be removed. Rounded corners may increase the safety of handling the ground spike.

Figure 20:
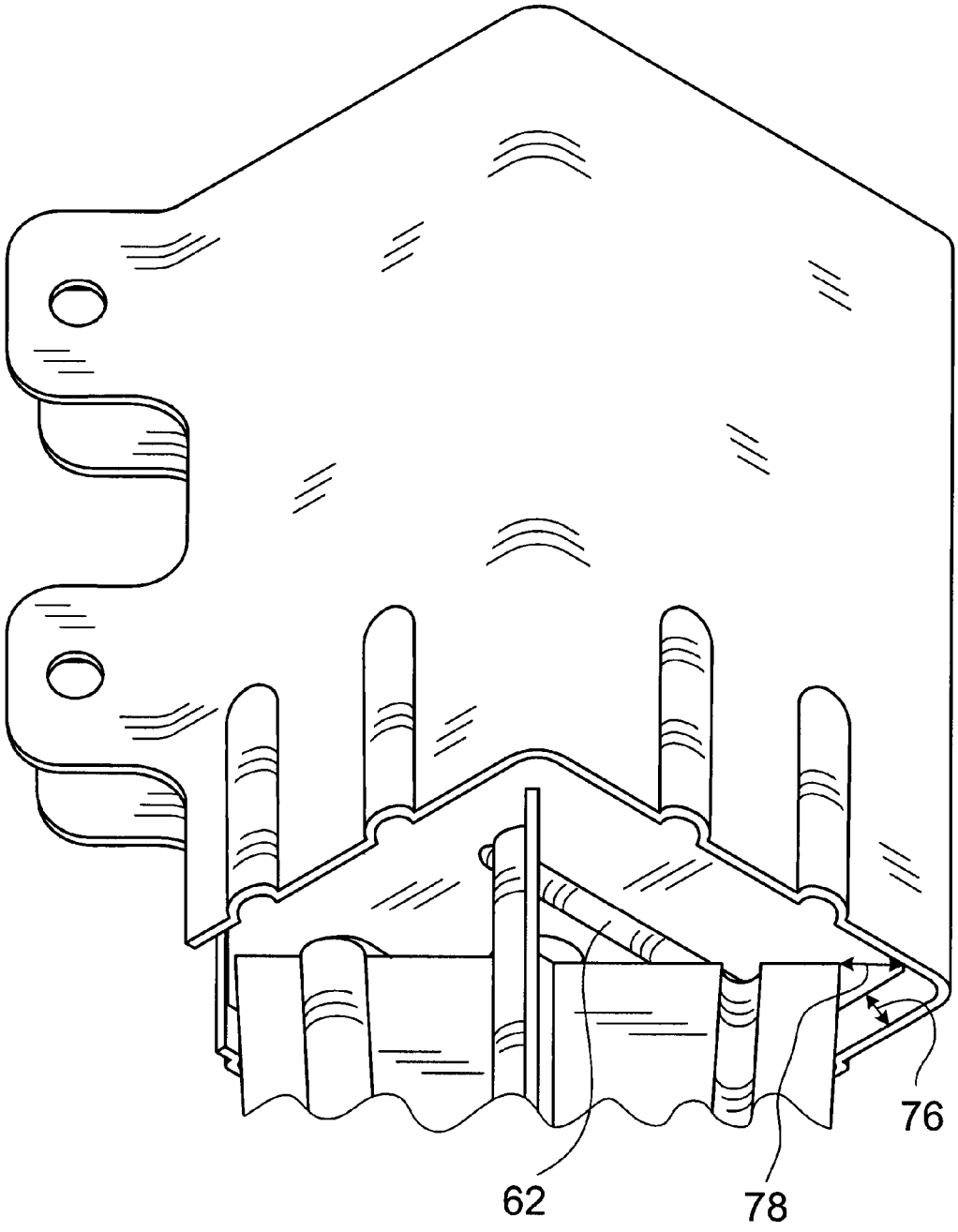
FIG. 20 is an enlarged partial perspective view of the socket portion of an embodiment of the invention.
Figure 21:
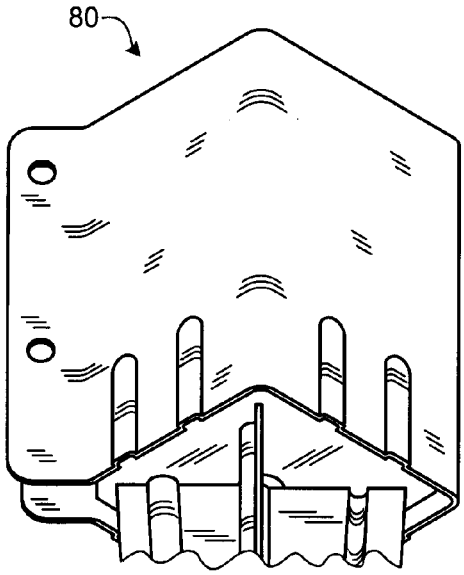
FIG. 21 is a partial perspective view of the socket portion of an embodiment of the invention.
Figure 22:
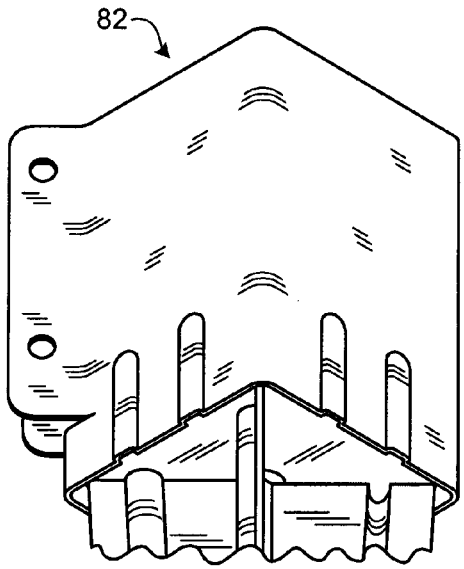
FIG. 22 is a partial perspective view of the socket portion of an embodiment of the invention.
Figure 23:
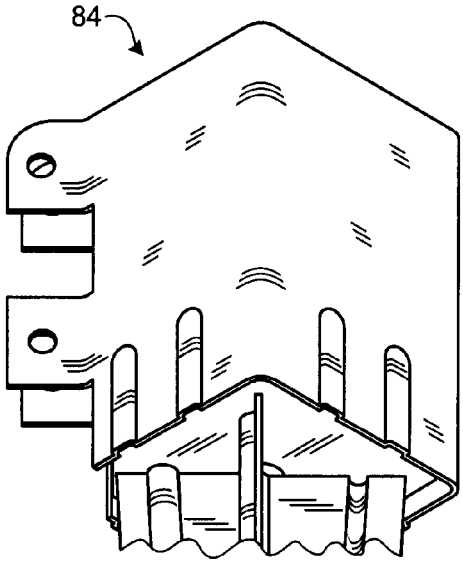
FIG. 23 is a partial perspective view of the socket portion of an embodiment of the invention.
Figure 24:
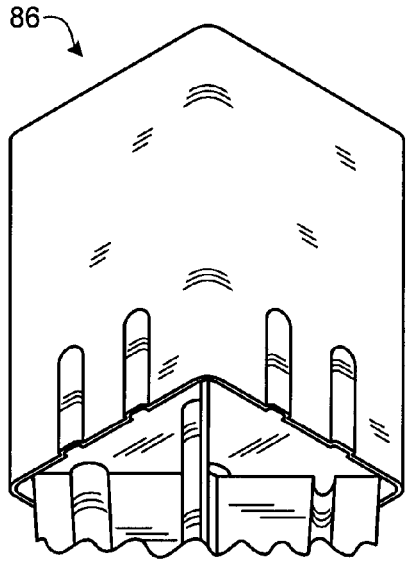
FIG. 24 is a partial perspective view of the socket portion of an embodiment of the invention.
Figure 25:
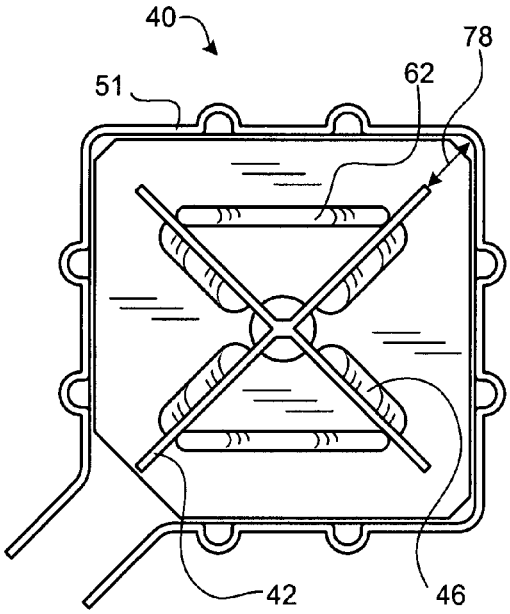
FIG. 25 is a bottom view of an embodiment of the invention.
Figure 26:
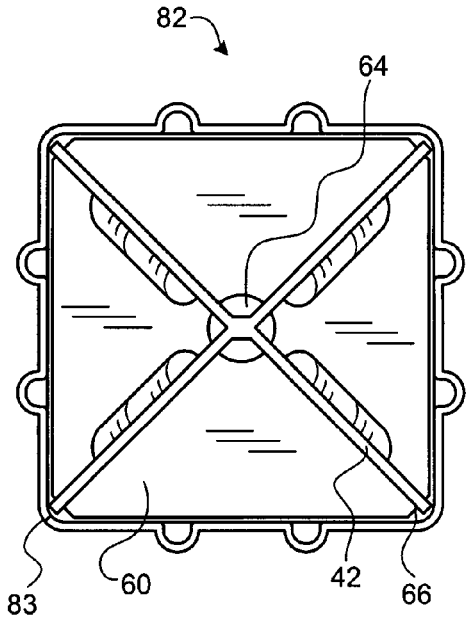
FIG. 26 is a bottom view of an embodiment of the invention.
Figure 27:
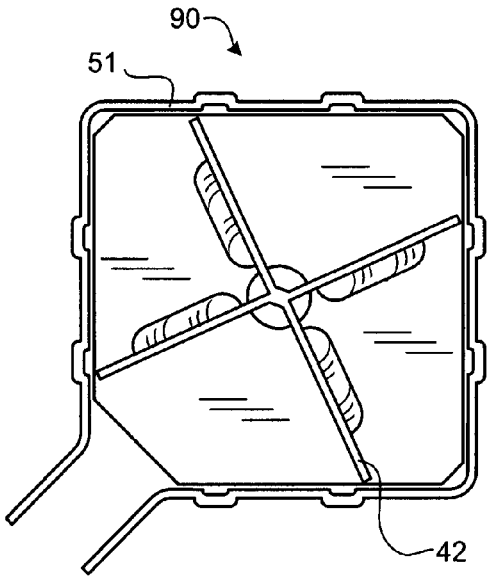
FIG. 27 is a bottom view of an embodiment of the invention.
Figure 28:
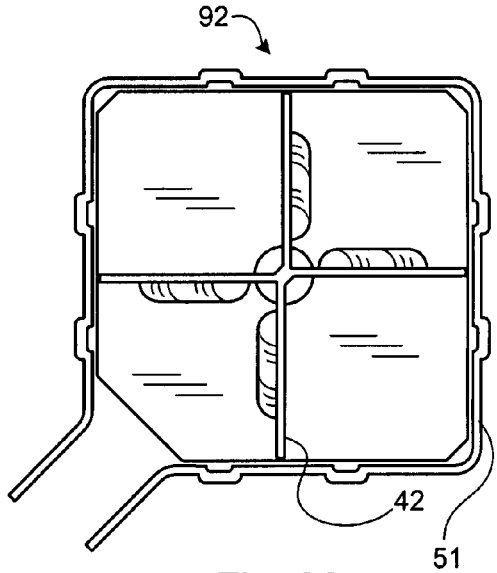
FIG. 28 is a bottom view of an embodiment of the invention.
Figure 29:
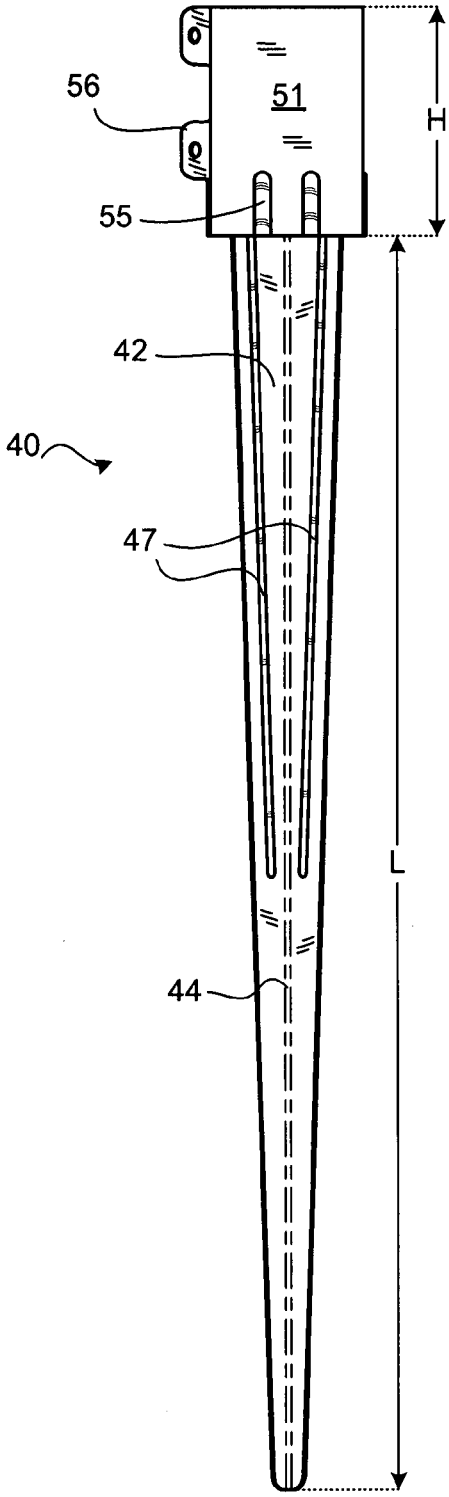
FIG. 29 is a side view of an embodiment of the invention.
Figure 30:
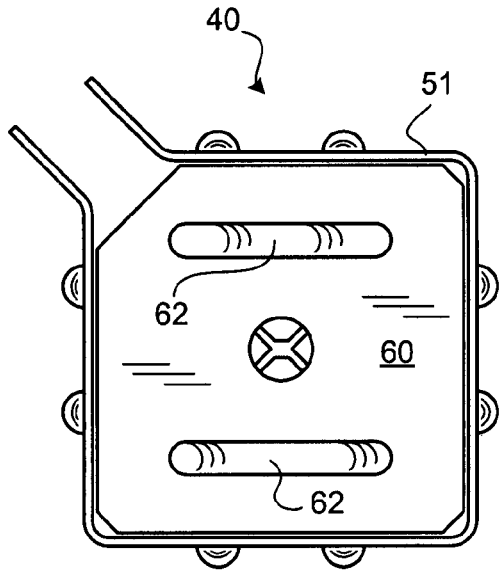
FIG. 30 is a top view of an embodiment of the invention.
Figure 31:
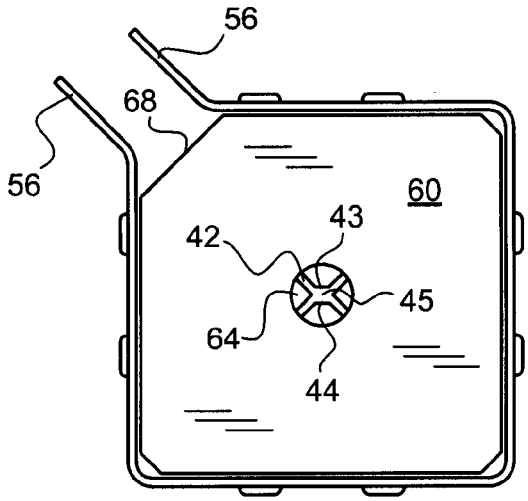
FIG. 31 is a top view of an embodiment of the invention.
Figure 32:
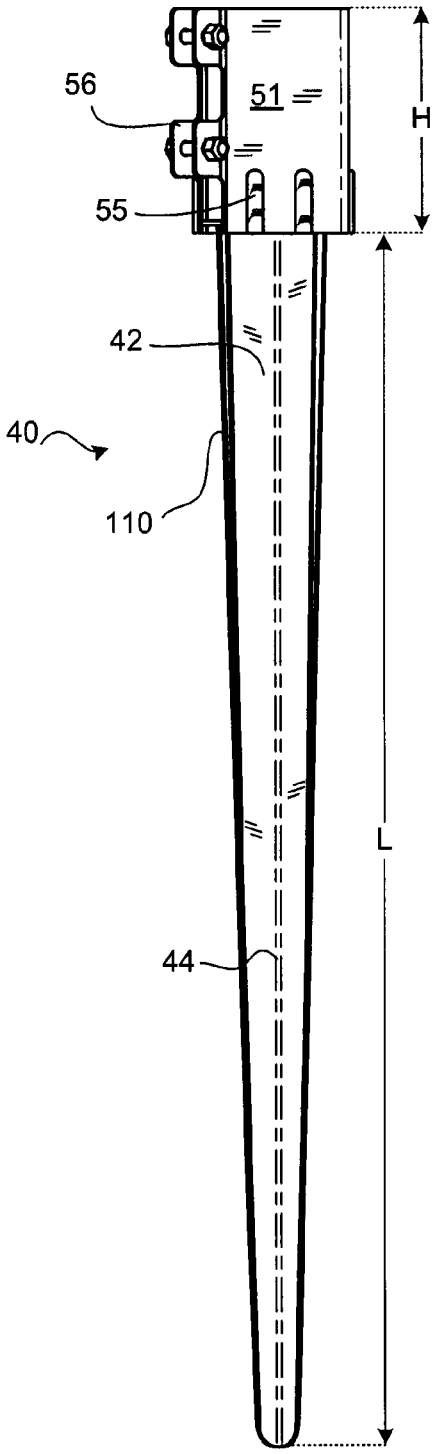
FIG. 32 is a side view of an embodiment of the invention.
Figure 33:
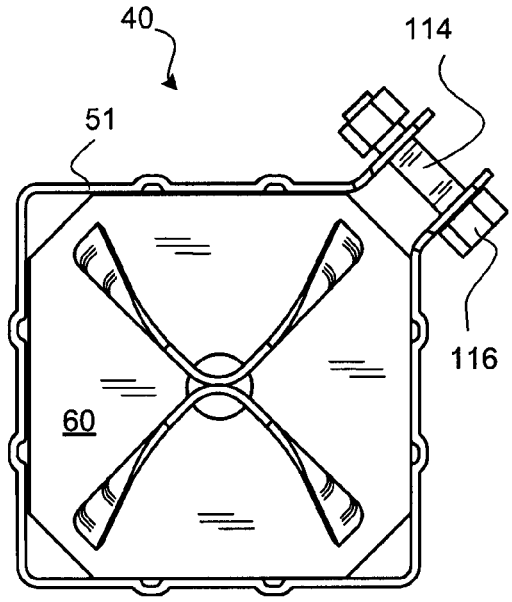
FIG. 33 is a bottom view of an embodiment of the invention.
Figure 34:
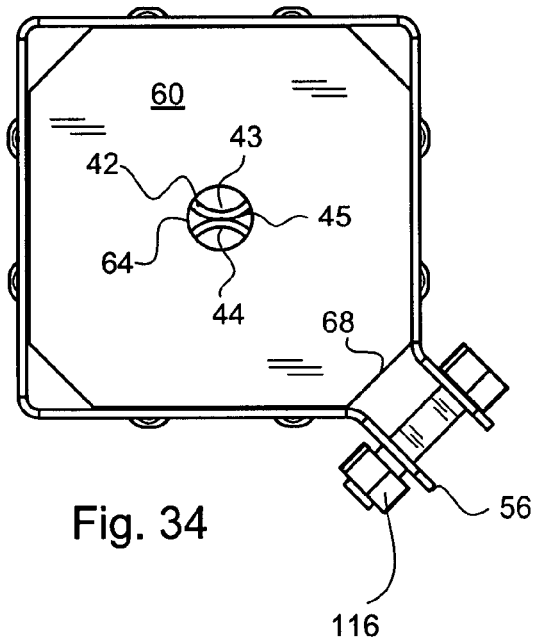
FIG. 34 is a top view of an embodiment of the invention.
Figure 35:
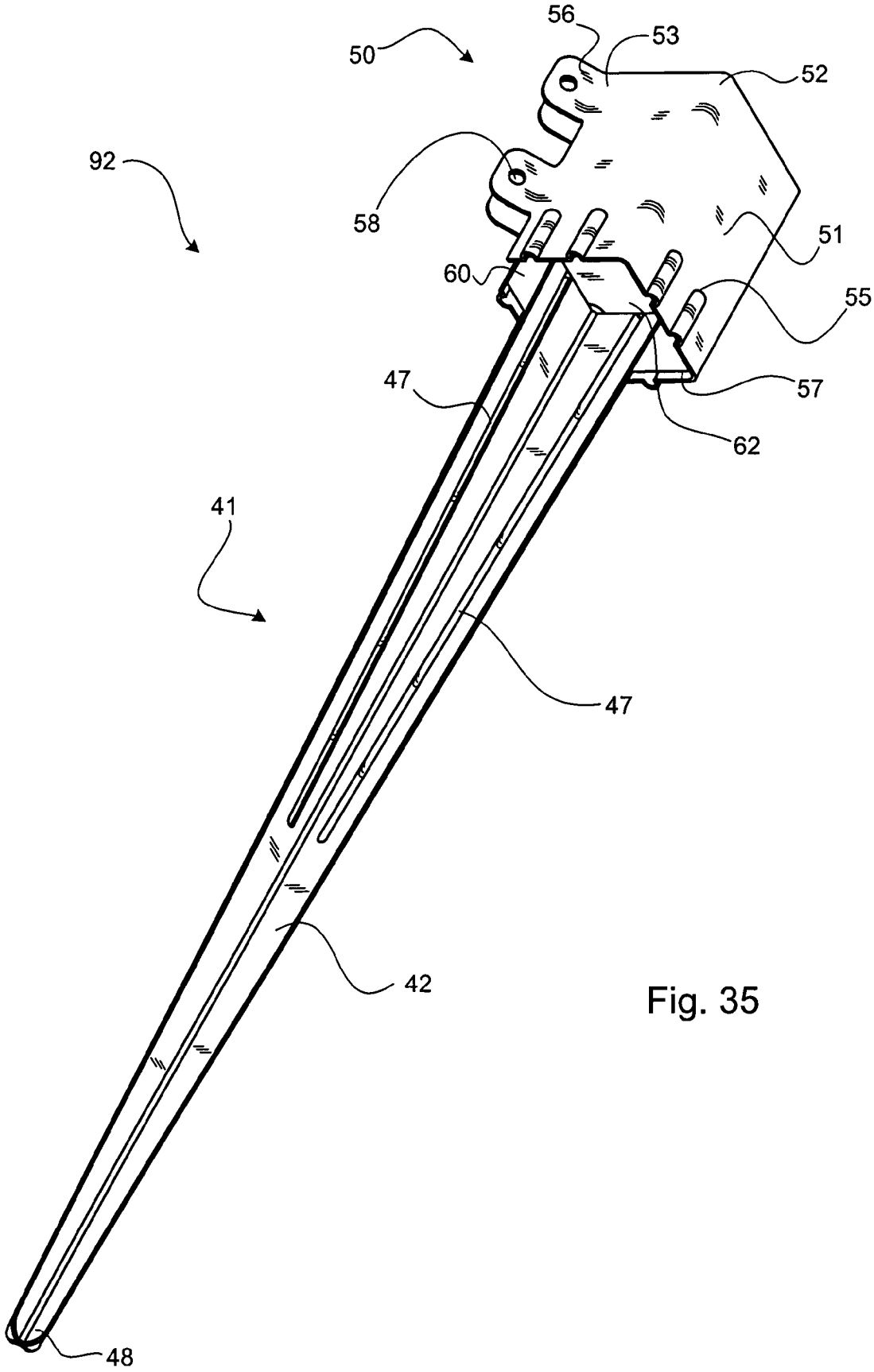
FIG. 35 is a perspective view of an embodiment of the invention.
Figure 36:
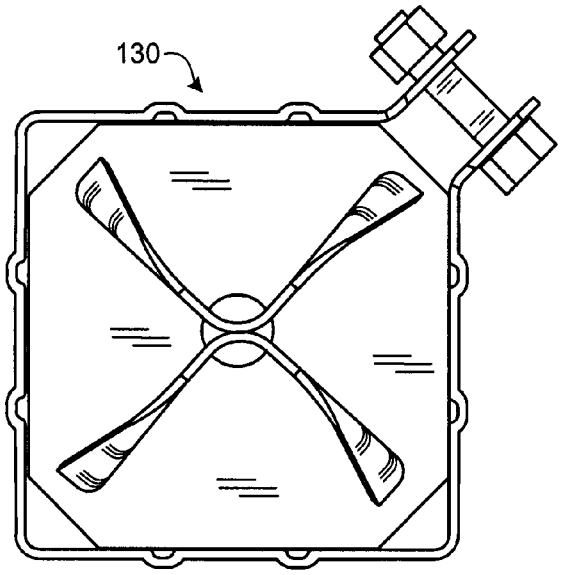
FIG. 36 is a bottom view of an embodiment of the invention.
Figure 37:
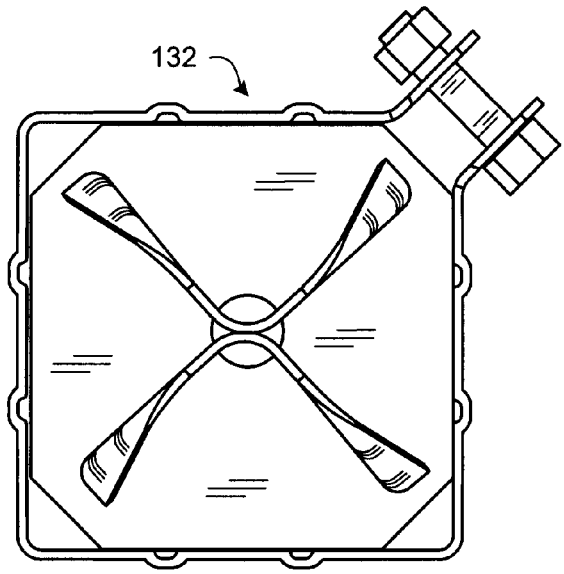
FIG. 37 is a bottom view of an embodiment of the invention.
Figure 38:
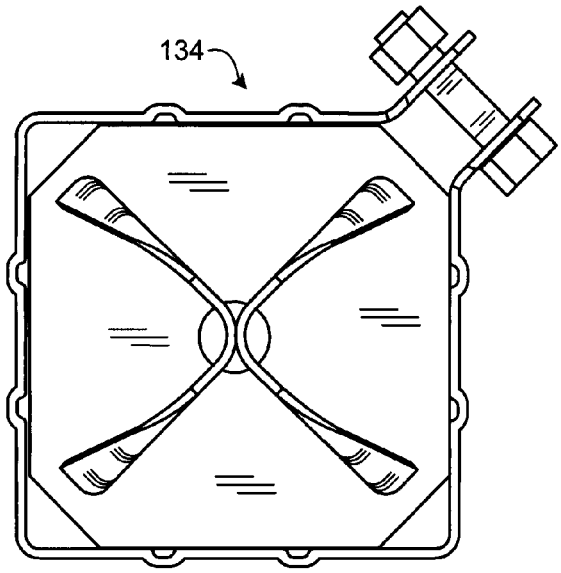
FIG. 38 is a bottom view of an embodiment of the invention.
Figure 39:
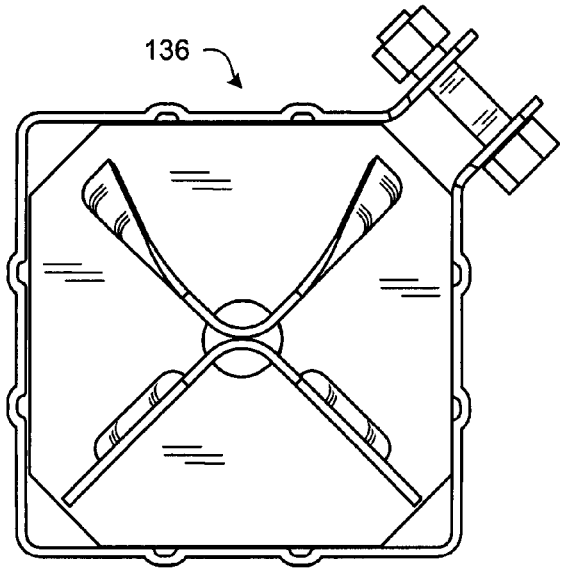
FIG. 39 is a bottom view of an embodiment of the invention.
Figure 40:
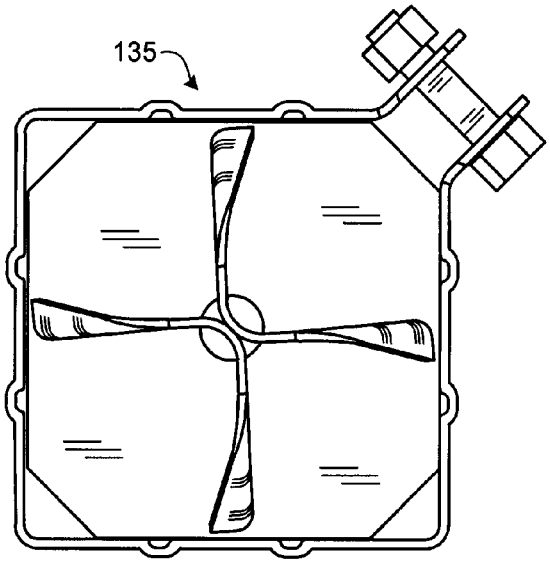
FIG. 40 is a bottom view of an embodiment of the invention.
Figure 41:
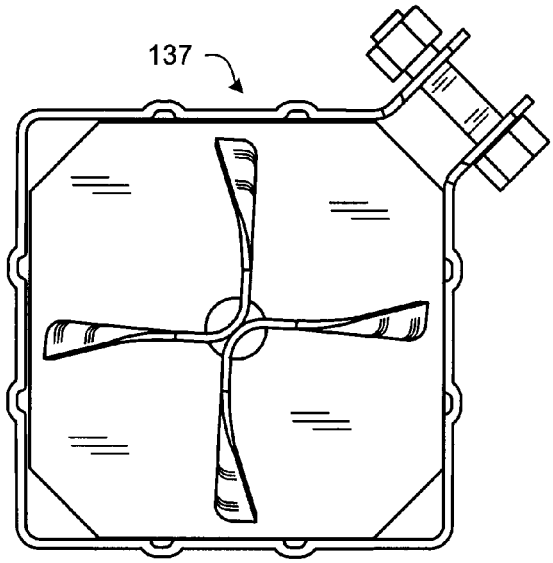
FIG. 41 is a bottom view of an embodiment of the invention.
Figure 42:
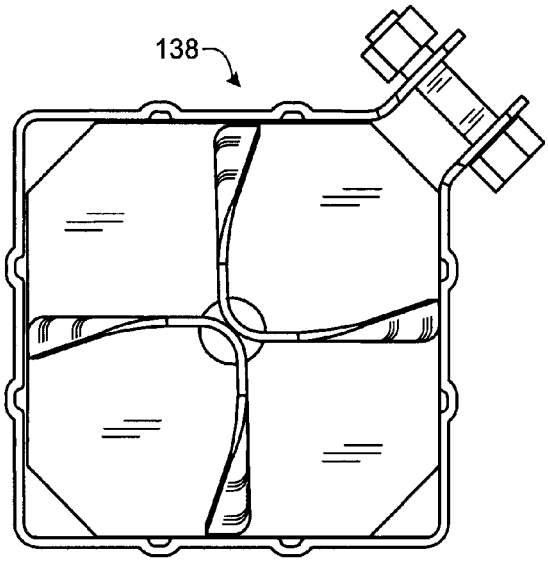
FIG. 42 is a bottom view of an embodiment of the invention.
Figure 43:
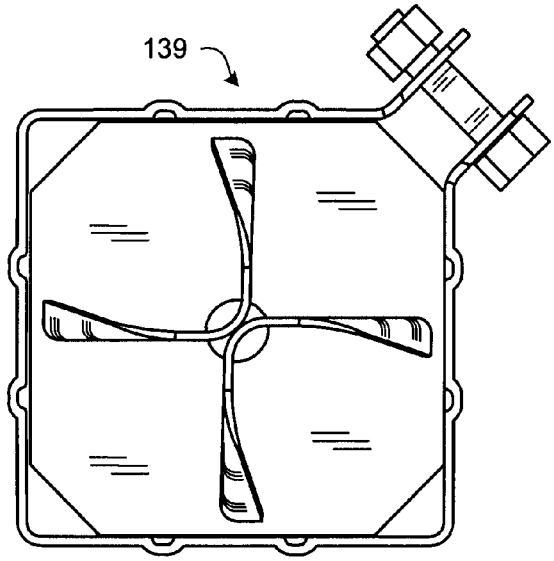
FIG. 43 is a bottom view of an embodiment of the invention.
Figure 44:
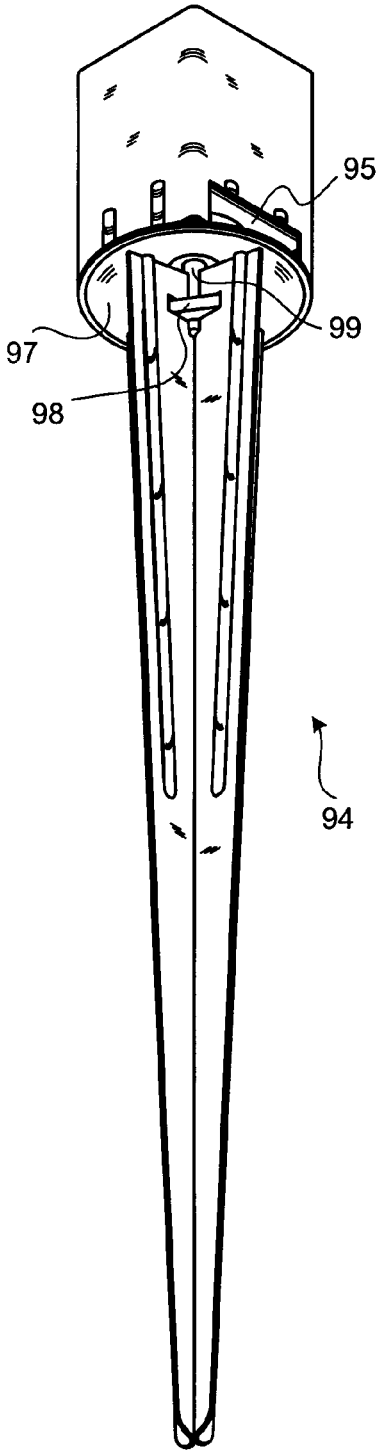
FIG. 44 is a bottom perspective view of an embodiment of the invention.
Figure 45:
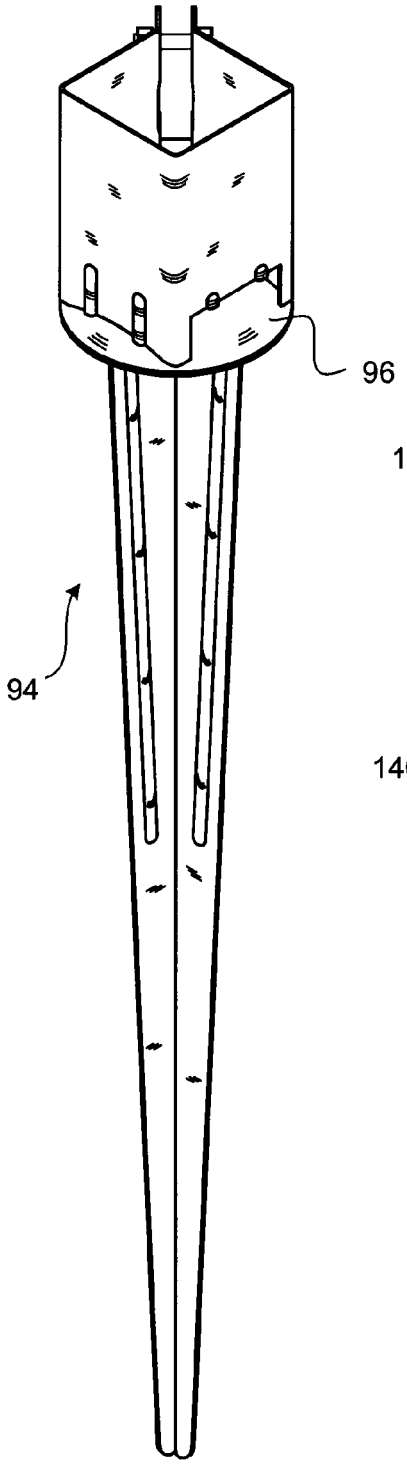
FIG. 45 is a top perspective view of an embodiment of the invention.
Figure 46:
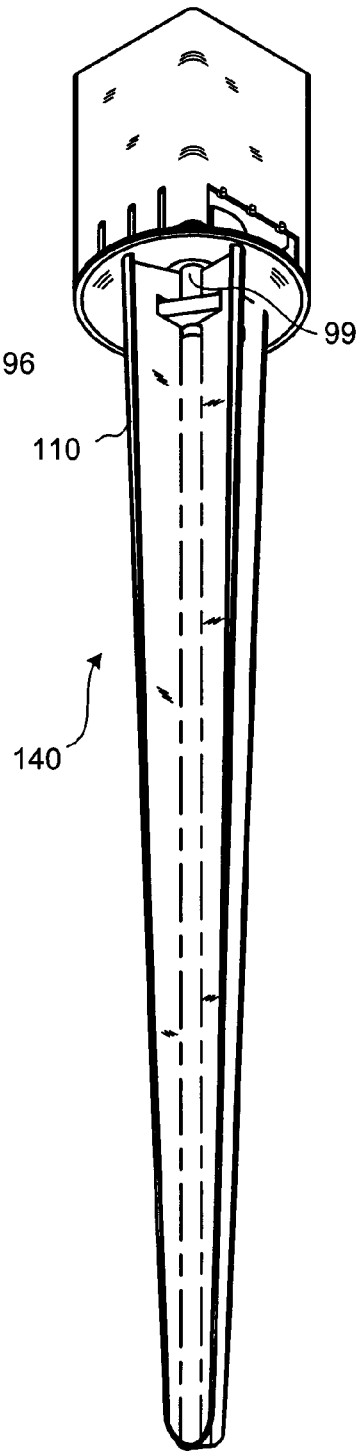
FIG. 46 is a bottom perspective view of an embodiment of the invention.
Figure 47:
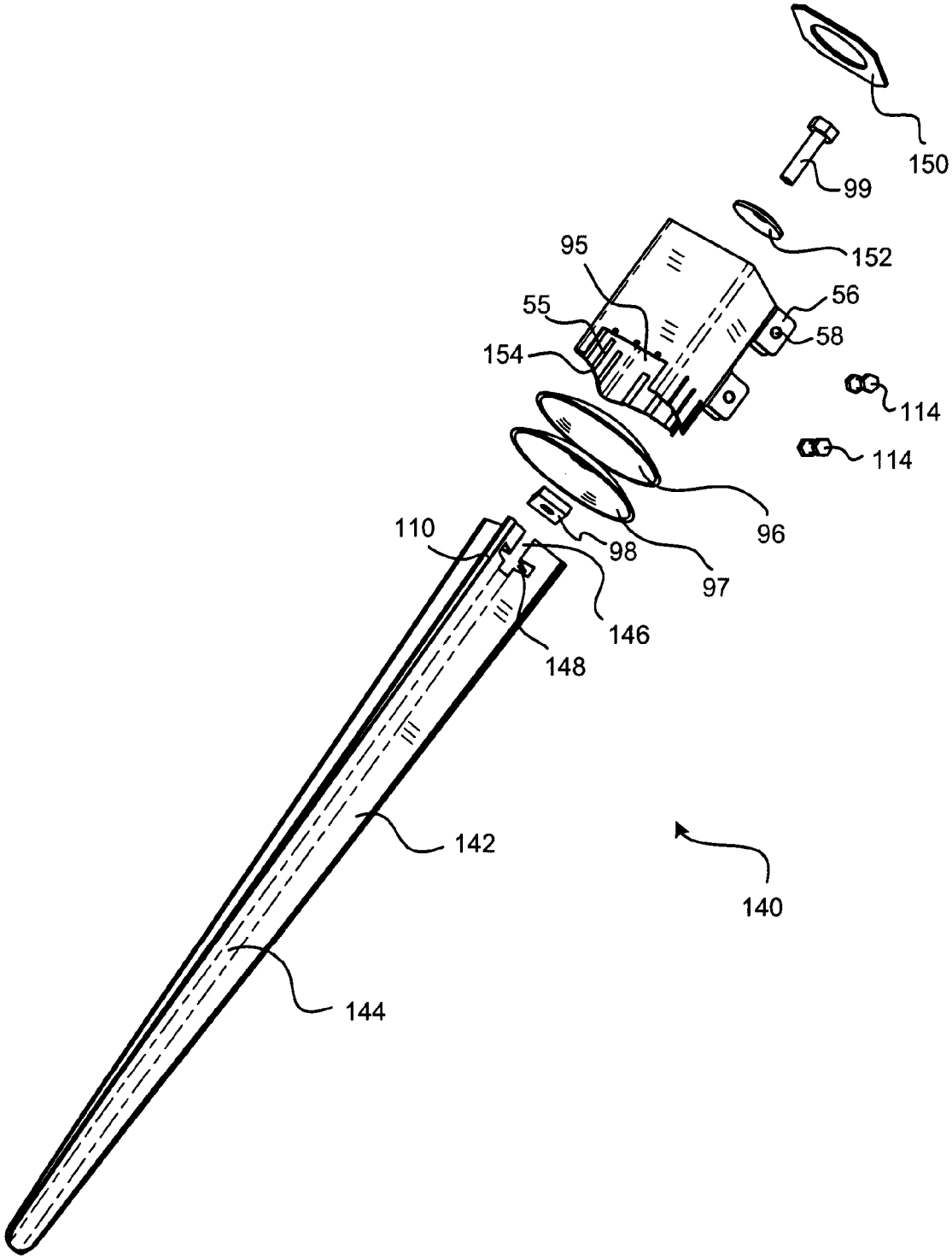
FIG. 47 is an perspective view of an embodiment of the invention.
Figure 48:
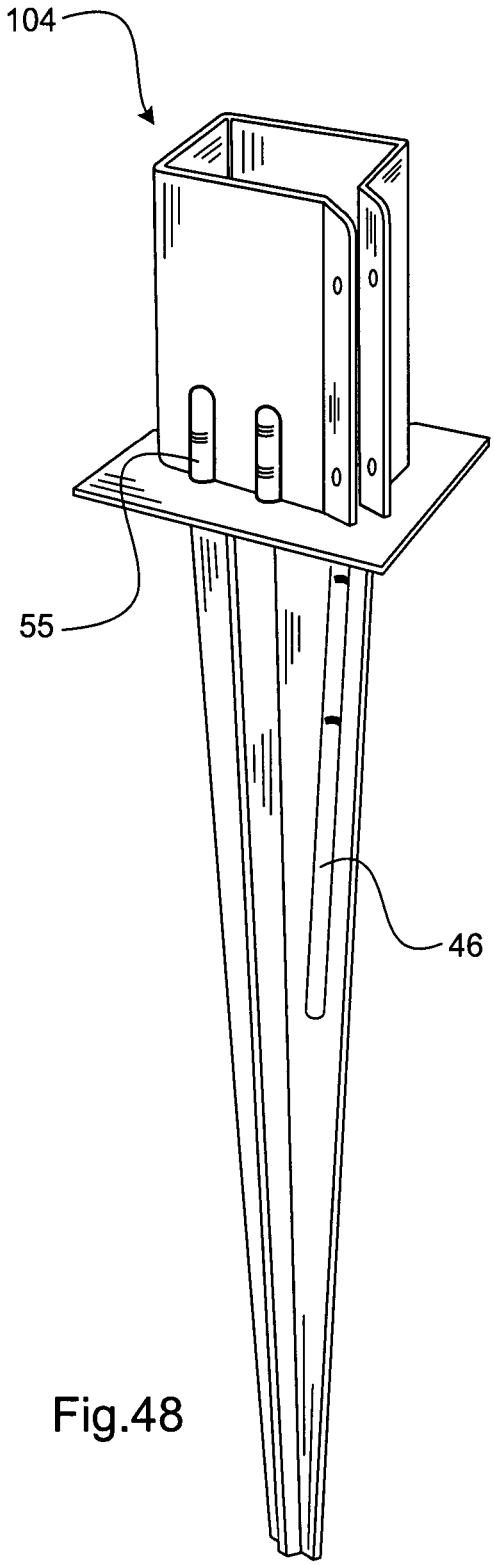
FIG. 48 is a perspective view of an embodiment of the invention.
Figure 49:
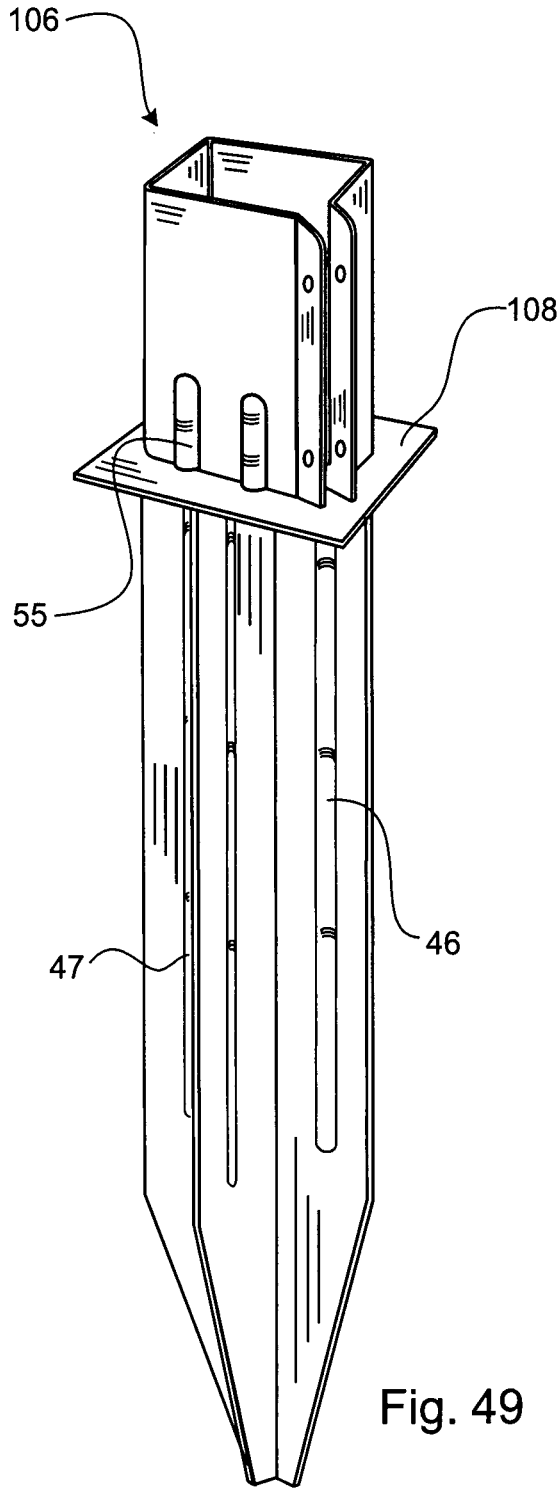
FIG. 49 is a perspective view of an embodiment of the invention.

FIG. 20 shows an enlarged perspective view of the underside of the socket portion 50 of embodiment 40. Plate 60 is welded a distance 76 away from the lower edge of the side walls 51. Distance 76 may be between 30 mm and 0 mm, preferably between 15 mm and 2 mm, and more preferably between 10 mm and 3 mm. One consideration in choosing a suitable distance 76 may be the distance that can be filled entirely with weld material.

Width W of the blade portion 41 may be varied to fit on plate 60. The distance 78 between the closest top edge corner of the blade portion 41 and the side wall 51 (measured along a line that continues in the plane of the blade) may be between 0 mm and 40 mm, preferably between 0 mm and 25 mm, and more preferably between 0 mm and 15 mm.

Although various clamping mechanisms have been described, embodiment 86 illustrates a post support with no clamping mechanism. The side walls can be welded together to form a join in place of the clamping mechanism.

Different orientations of the blades are within the scope of the invention. Embodiments 40 and 82 show an X-shaped design wherein the blades extend towards the corners of the socket. Embodiment 92 shows a +-shaped cross-section where the blades extend towards the mid sections of the walls 51. Embodiment 90 shows an orientation of the blades that is intermediate between the X-shape and the +-shape cross-sections. The distance 78 can be varied, such as from approximately 0 mm shown in embodiment 82 to between 5 and 25 mm shown in embodiment 40.

Embodiment 40 has two reinforcement lines on the plate 60, whereas embodiments 82, 90 and 92 do not have reinforcement lines on the plate.

The corners and aperture 64 that may be cut from the plate 60 may allow drainage of powder during powder coating and may allow drainage of fluid after installation.

Embodiment 92 has the blade portion 41 oriented 90 degrees from the orientation shown in embodiment 40.

Embodiments 94 and 140 are adjustable ground spikes, having two domes 96 and 97 sitting in place of the base plate 60. A bolt 99 and nut 98 arrangement allows adjustment of the orientation of the socket from the blades portion during installation. This may be advantageous during installation, particularly if the blades are not driven into the ground straight. The socket may have an opening 95 to allow access by a wrench or other device to adjust and tighten the head of the bolt during installation. Domes 96 and 97 may be any suitable thickness, such as between 3.0 mm and 9.0 mm, and more preferably between 5.0 mm and 7.5 mm. The domes 96 and 97 may be stamped with reinforcement lines, whether concentric circles or lines that radiate outward. Reinforcement lines can be stamped in the blades and in the socket.

For embodiments 94 and 140, base plate 60 is a domed surface, namely lower dome 97. In alternate embodiments of adjustable ground spikes, the base plate 60 may be a flat surface with a circular shape configured so that an upper dome can slide thereupon to adjust the angle and position of the post-receiving socket.

Embodiment 100 is an example of a post support that could be set in concrete. This type of post support does not require a blade portion. However the socket 50 and the plate 60 could be constructed in the same manner.

Embodiment 102 is an example of a post support that can be bolted down to a surface, such as a concrete surface or a wooden deck. The socket may be constructed as in embodiment 40. The plate may extend outward beyond the socket walls.

Embodiments 104 and 106 are examples of post supports having plates 108 that extend outward beyond the socket walls. Embodiment 106 also shows an alternate pattern for the construction of the blade elements. Reinforcement lines can be placed in some or all of the blades, socket and plate 108 in embodiments 104 and 106.

Post support ground spikes are installed by placing a short post segment into the post socket, then hammering the post segment, which in turn drives the post support into the ground. No digging or mixing concrete is involved.

Different portions of the ground spike may be made of different types of metal, whether that be different alloys, different coatings on the metal, different treatments of the metal, and/or different thicknesses of metal. Early test results of the invention indicate that the portion of the ground spike that requires the thickest and/or strongest material is the base plate 60. Test results further indicate that the portion of the ground spike that requires the least strength and/or may permit the least thickness is the socket portion 50, with the blade portion 41 requiring an intermediate strength and/or thickness of metal.

Test results also indicate that the socket portion 50 requires the most strength at and near the weld to the base plate 60. For this reason, the reinforcement lines 55 in embodiment 40 only appear at or near the area in which the side walls 51 are welded to the base plate 60. The reinforcement lines 55 may be raised slightly above the area in which the base plate 60 is welded so that there is no gap in the weld between the plate 60 and the side walls 51.

The top one to two thirds of the blade portion require the most rigidity and the most resistance to torsion. The tips of the blades 48 also must be relatively strong to avoid distortion when hitting rocks or other hard items when driven into the ground.

It is possible to weld additional pieces onto the blades, below the reinforcement lines, to add extra rigidity to the blade portion. This may be particularly useful when trying to minimize the thickness of the blades and yet are unable to stamp suitable reinforcement lines in certain sections of the blades, or where certain portions of the blades require extra reinforcement.

In alternate embodiments, reinforcement lines may be added, where practicable, to any portion of the ground spike without departing from the invention. The nature and pattern of the reinforcement lines, as well as the thickness of the lines and the depths of the contours may be varied.

Typically ground spike post supports are used to support posts that are generally square in cross section, for example a 4×4 post (which has side dimensions in cross section of 3.5 inches). However it is also possible to attach a suitable post socket for supporting posts with non-square cross sections, such as a rectangular cross-section, a triangular cross-section, a circular cross-section or an oval cross-section. Other examples of supportable posts include 2×2, 3×3 and 5×5 in the imperial system, and 9×9, 7×7 and 5×5 posts in the metric system (i.e. 9 cm×9 cm). The dimensions of the socket of the ground spike would vary accordingly, for example may be 91 mm to hold a 9 cm×9 cm post, 71 mm to hold a 7 cm×7 cm post, or similar suitable variations. The distance between the edge of the post and the edge of the post support socket may be varied to correspond with the type of fastening mechanism chosen for the socket. For example a socket without a clamping mechanism which merely has holes for placing one or two anchoring bolts through the post and socket might be a closer fit than a socket having wedge grips.

Ground spikes without lumber supporting sockets can be used to secure outdoor lighting, such as flood lamps or garden lights, garden ornaments, and water sprinkler hoses and nozzles.

Although ground spikes according to this invention have been primarily described as being comprised of metal, it is within the scope of the invention that the ground spike may comprise other suitable material such as plastic. Accordingly, ground spikes according to this invention may be made from injection molding. In such cases references to welding would clearly not apply. The ground spike may be made of a unitary piece of plastic, such as PVC, or may comprise more than one piece of plastic and attached together by adhesion methods known in the art.

It will be appreciated by those skilled in the art that although certain embodiments have been described above in some detail, many modifications may be practiced without departing from the principles of the invention.

What is claimed is:

1. A ground spike, comprising:

a plurality of vertically oriented blades, the blades configured together along a central vertical axis;

at least one of said blades comprising an outer edge portion, said outer edge portion defined at least in part by a bend proximate to a longitudinal outer edge of said at least one of said blades;

a plate coupled to the plurality of vertically oriented blades along a top surface of the blades, wherein said top surface of the blades includes a top surface of said outer edge portions;

wherein each of said blades, with another one of said blades, is integrally formed, from a single sheet of material, as one of a plurality of pairs of blades, wherein said bend is integrally formed from said single sheet of material, and wherein said bend extends for more than half of said longitudinal outer edge's length;

wherein a width of said outer edge portion is tapered over at least half of said bend's length; and wherein said central vertical axis and said bend are non-parallel to one another.

2. The ground spike of claim 1 wherein the plate comprises a bent outer edge of said plate.

3. The ground spike of claim 2 wherein the ground spike comprises plastic.

4. The ground spike of claim 2 wherein the ground spike comprises metal.

5. The ground spike of claim 4 wherein the plurality of blades is 4 blades.

6. The ground spike of claim 5 wherein the outer edge portion is bent with respect to a surface of said blade at an angle between 45 degrees and 120 degrees.

7. The ground spike of claim 6 wherein the outer edge portion is bent with respect to a surface of said blade at an angle between 80 degrees and 100 degrees.

8. The ground spike of claim 7 wherein the outer edge portion is bent with respect to a surface of said blade at an angle between 85 degrees and 95 degrees.

9. The ground spike of claim 7 wherein the bent outer edge portion terminates at a notch at a distance between 5% and 30% of the length of the blade away from a tip of the blade.

10. The ground spike of claim 9 wherein the bent outer edge portion terminates at a notch at a distance between 10% and 20% of the length of the blade away from a tip of the blade.

11. The ground spike of claim 9 wherein the bent outer edge portion terminates at a notch at a distance approximately 15% of the length of the blade away from a tip of the blade.

12. The ground spike of claim 2 wherein the bent outer edge of said plate is bent with respect to a surface of said plate at an angle between 45 degrees and 120 degrees.

13. The ground spike of claim 12 wherein the bent outer edge of said plate is bent with respect to a surface of said plate at an angle between 80 degrees and 100 degrees.

14. The ground spike of claim 13 wherein the bent outer edge of said plate is bent with respect to a surface of said plate at an angle between 85 degrees and 95 degrees.

15. The ground spike of claim 14 further comprising a post-receiving socket welded to the plate.

16. The ground spike of claim 15 wherein the socket is welded to the plate along each of four substantially perpendicular socket walls.

17. The ground spike of claim 16 wherein a plurality of reinforcement lines are stamped on each socket wall.

18. The ground spike of claim 17 wherein the plate extends in a plane, and said substantially perpendicular socket walls extend normal to said plane.

19. The ground spike of claim 18 wherein the reinforcement lines are vertical reinforcement lines that extend normal to the plane of the plate.

20. The ground spike of claim 19 wherein the socket is of sufficient dimensions to hold a 4×4 post.

21. The ground spike of claim 19 wherein the socket further comprises a set of opposing clamping tabs having a first clamping aperture therethrough for receiving a tightening bolt.

22. The ground spike of claim 19 wherein the plate comprises a drainage aperture therethrough.

23. The ground spike of claim 22 wherein the drainage aperture in the plate is a central drainage aperture.

24. The ground spike of claim 23 wherein the plate further comprises apertures in each closed corner between perpendicular socket walls.

25. The ground spike of claim 19 wherein said pairs of blades are welded together at a joint.

26. The ground spike of claim 19 wherein said socket is welded to said plate at an elevated distance from a bottom edge of said socket.

27. The ground spike of claim 26 wherein said elevated distance is between 1 mm and 20 mm.

28. The ground spike of claim 27 wherein said elevated distance is between 2 mm and 10 mm.

29. The ground spike of claim 28 wherein said elevated distance is between 2.5 mm and 7 mm.

30. The ground spike of claim 27 wherein said socket, said blades and said plate each comprise steel having a thickness between 1.3 mm and 3.5 mm.

31. The ground spike of claim 30 wherein said socket, said blades and said plate each comprise steel of between 1.5 mm and 2.5 mm.

32. The ground spike of claim 31 wherein said socket and said blades are a different thickness of metal from said plate.

33. The ground spike of claim 30 wherein said socket and said blades each comprise steel of between 1.5 mm and 2.5 mm and said plate comprises steel of between 2.0 mm and 3.5 mm.

34. The ground spike of claim 30 wherein each of said socket, said blades, and said plate comprise different thicknesses of metal.

35. The ground spike of claim 30 wherein said socket and said blades each comprise steel of between 1.7 mm and 1.9 mm and said plate comprises steel of between 2.3 mm and 2.7 mm.

36. The ground spike of claim 35 wherein said socket and said blades each comprise steel of about 1.8 mm and said plate comprises steel of about 2.5 mm.

37. The ground spike of claim 36 wherein the plate comprises a plurality of reinforcement lines stamped therein.

38. The ground spike of claim 37 wherein the blades are oriented in an X cross-section, the blades having upper outer edges extending towards corners of the substantially perpendicular socket walls.

39. The ground spike of claim 38 wherein the upper outer edges are welded to the corners of the substantially perpendicular socket walls.

40. The ground spike of claim 34 wherein the blades are oriented in a + cross-section, the blades having upper outer edges extending towards the mid sections of said substantially perpendicular socket walls.

41. The ground spike of claim 40 wherein the upper outer edges are welded to the mid sections of the substantially perpendicular socket walls.

42. A ground spike, comprising:

a plurality of vertically oriented blades, the blades configured together along a central vertical axis;

at least one of said blades comprising:

a vertically oriented taper; and an outer edge portion, said outer edge portion defined at least in part by a bend proximate to a longitudinal outer edge of said at least one of said blades, wherein said bend extends for more than half of said longitudinal outer edge's length and extends within at least a portion of said taper;

wherein a width of said outer edge portion is tapered over at least half of said bend's length; and a plate coupled to the plurality of vertically oriented blades along a top surface of the blades, wherein said top surface of the blades includes a top surface of said outer edge portions;

wherein said central vertical axis and said bend are non-parallel to one another.

* * * * *